US009152097B2

(12) United States Patent
Nojima et al.

(10) Patent No.: US 9,152,097 B2
(45) Date of Patent: Oct. 6, 2015

(54) FIXING APPARATUS

(71) Applicant: CANON KABUSHIKI KAISHA, Tokyo (JP)

(72) Inventors: Koji Nojima, Abiko (JP); Ryuichi Kojima, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/024,014

(22) Filed: Sep. 11, 2013

(65) Prior Publication Data

US 2014/0086616 A1 Mar. 27, 2014

(30) Foreign Application Priority Data

Sep. 24, 2012 (JP) ..... 2012-209396
Aug. 5, 2013 (JP) ..... 2013-162436

(51) Int. Cl.
*G03G 15/20* (2006.01)
*G03G 21/00* (2006.01)

(52) U.S. Cl.
CPC ..... *G03G 15/2017* (2013.01); *G03G 15/2025* (2013.01)

(58) Field of Classification Search
CPC ..... G03G 15/2017
USPC ..... 399/98, 322
See application file for complete search history.

(56) References Cited

U.S. PATENT DOCUMENTS 5,525,775 A 6/1996 Setoriyama et al.
7,589,300 B2 9/2009 Nojima
8,139,995 B1 3/2012 Fujita et al.
8,497,055 B2 7/2013 Kikushima
8,938,181 B2 1/2015 Suzuki
2011/0243598 A1* 10/2011 Suzuki ..... 399/98
2012/0058424 A1* 3/2012 Kikushima ..... 430/105

(Continued)

FOREIGN PATENT DOCUMENTS

CN 102378942 A 3/2012
CN 102385267 A 3/2012

(Continued)

OTHER PUBLICATIONS

Mar. 25, 2015 Office Action in counterpart Russian Patent Application No. 2013143113/12(066231) and English translation thereof.

(Continued)

*Primary Examiner* — David Gray
*Assistant Examiner* — Michael Harrison
(74) *Attorney, Agent, or Firm* — Fitzpatrick, Cella, Harper & Scinto

(57) ABSTRACT

A fixing apparatus includes: first and second rotatable member configured to heat-fix, at a nip therebetween, an unfixed toner image formed on a sheet by using a toner containing a parting agent; a casing, configured to accommodate the first and second rotatable member, including a sheet introducing opening and a sheet discharging opening; and a suppressing portion configured to suppress diffusion, toward the sheet discharging opening, of particles having a predetermined diameter resulting from a parting agent in the neighborhood of the sheet introducing opening, wherein the suppressing portion is provided in a position of 0.5 mm or more and 3.5 mm or less from a surface of the first rotatable member in a space in the casing from the sheet introducing opening to the sheet discharging opening.

13 Claims, 17 Drawing Sheets

(56) References Cited

U.S. PATENT DOCUMENTS

| | | | |
|---|---|---|---|
| 2014/0086617 | A1 | 3/2014 | Nojima |
| 2014/0178091 | A1 | 6/2014 | Sugiyama et al. |

FOREIGN PATENT DOCUMENTS

| | | | |
|---|---|---|---|
| JP | 4-44075 | A | 2/1992 |
| JP | 2002-123097 | A | 4/2002 |
| JP | 2004-151240 | A | 5/2004 |
| JP | 2008-185878 | | 8/2008 |
| JP | 2010-217580 | A | 9/2010 |
| JP | 2011-112708 | A | 6/2011 |

OTHER PUBLICATIONS

Jul. 8, 2015 Office Action in counterpart Chinese Patent Application No. 201310437408.0 and English translation thereof.

* cited by examiner (a)

(b)

(a)

(b)

(a)

(b)

FIXING APPARATUS

FIELD OF THE INVENTION AND RELATED ART

The present invention relates to a fixing apparatus (device) for fixing a toner image on a sheet. This fixing apparatus is mountable in an image forming apparatus such as a copying machine, a printer, a facsimile machine or a multi-function machine having a plurality of functions of these machines.

In a conventional image forming apparatus of an electrophotographic type, the toner image is formed on the sheet by using a toner in which a parting agent (wax) is incorporated, and then is fixed under heat and pressure in the fixing apparatus.

It has been known that during the fixing, the wax incorporated in the toner is vaporized and immediately thereafter is condensed. According to knowledge of the present inventors, it has been found that in the neighborhood of a sheet-introducing opening of the fixing apparatus, the condensed wax (particles of several nm to several hundred nm, hereinafter referred to as also a dust) is present and suspended in a large amount. When no means is taken against such a wax, immediately after its condensation, which is present in the large amount in the neighborhood of the sheet introducing opening, most of the wax is diffused to outside of the fixing apparatus, so that there is a fear that an image is adversely affected. Therefore, it has been required that the wax immediately after its condensation is increased in particle diameter so as not to be diffused to the outside of the fixing apparatus.

On the other hand, in a fixing apparatus of an electromagnetic induction type described in Japanese Laid-Open Patent Application (JP-A) 2010-217580, in order to prevent the wax from being fixed and deposited on a coil holder, a heat generating member is provided in the neighborhood of the coil holder. Specifically, the wax is liquefied by heating the coil holder by the heat generating member, so that the wax fixed on the coil holder is dropped downward.

Further, in a fixing apparatus described in JP-A 2011-112708, when fine particles deposited on a fixing roller are removed by a cleaning web, a trapping material for trapping the fine particles is contained in the cleaning web.

However, in the fixing apparatuses described in JP-A 2010-217580 and JP-A 2011-112708, the dust present in a large amount in the neighborhood of the sheet introducing opening cannot be suppressed from being diffused as it is to the outside of the fixing apparatuses, and therefore the means therein do not constitute a solution.

SUMMARY OF THE INVENTION

A principal object of the present invention is to provide a fixing apparatus capable of suppressing particles, having a predetermined diameter, resulting from a parting agent being diffused to outside of the fixing apparatus as it is.

Another object of the present invention is to provide a fixing apparatus capable of accelerating an increase in particle diameter of the particles, having the predetermined diameter, resulting from the parting agent.

According to an aspect of the present invention, there is provided a fixing apparatus comprising: first and second rotatable member configured to heat-fix, at a nip therebetween, an unfixed toner image formed on a sheet by using a toner containing a parting agent; a casing, configured to accommodate the first and second rotatable member, including a sheet introducing opening and a sheet discharging opening; and a suppressing portion configured to suppress diffusion, toward the sheet discharging opening, of particles having a predetermined diameter resulting from a parting agent in the neighborhood of the sheet introducing opening, wherein the suppressing portion is provided in a position of 0.5 mm or more and 3.5 mm or less from a surface of the first rotatable member in a space in the casing from the sheet introducing opening to the sheet discharging opening.

According to another aspect of the present invention, there is provided a fixing apparatus comprising: first and second rotatable member configured to fix, at a nip therebetween, a toner image formed on a sheet by using a toner containing a parting agent; a casing, configured to accommodate the first and second rotatable member, including a sheet introducing opening and a sheet discharging opening; and a suppressing mechanism, provided in a space in the casing from the sheet introducing opening to the sheet discharging opening, configured to be adjacent to airflow in the neighborhood of the first rotatable member along a rotational direction of the first rotatable member and configured to suppress airflow in an opposite direction of the airflow along the rotational direction.

According to a further aspect of the present invention, there is provided a fixing apparatus comprising: first and second rotatable member configured to fix, at a nip therebetween, a toner image formed on a sheet by using a toner containing a parting agent; a casing, configured to accommodate the first and second rotatable member, including a sheet introducing opening and a sheet discharging opening; and a suppressing portion configured to suppress diffusion, toward the sheet discharging opening, of particles having a predetermined diameter resulting from a parting agent, wherein the suppressing portion is provided in the neighborhood of a surface of the first rotatable member in a space in the casing from the sheet introducing opening to the sheet discharging opening, wherein when a gap between the suppressing portion and the first rotatable member is G (mm) and a peripheral speed of the first rotatable member is V (mm/s), the following relationship is satisfied:

$$0.5 \leq G \leq 0.0059 \times V + 0.72.$$

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Embodiments of a fixing apparatus according to the present invention will be specifically described below. Incidentally, unless otherwise specified, within a scope of concept of the present invention, constitutions of various devices can be replaced with other constitutions.

Embodiment 1

(1) General Structure of Image Forming Apparatus

Before describing the fixing apparatus, first, a general structure of an image forming apparatus will be discussed.

Figure 3:
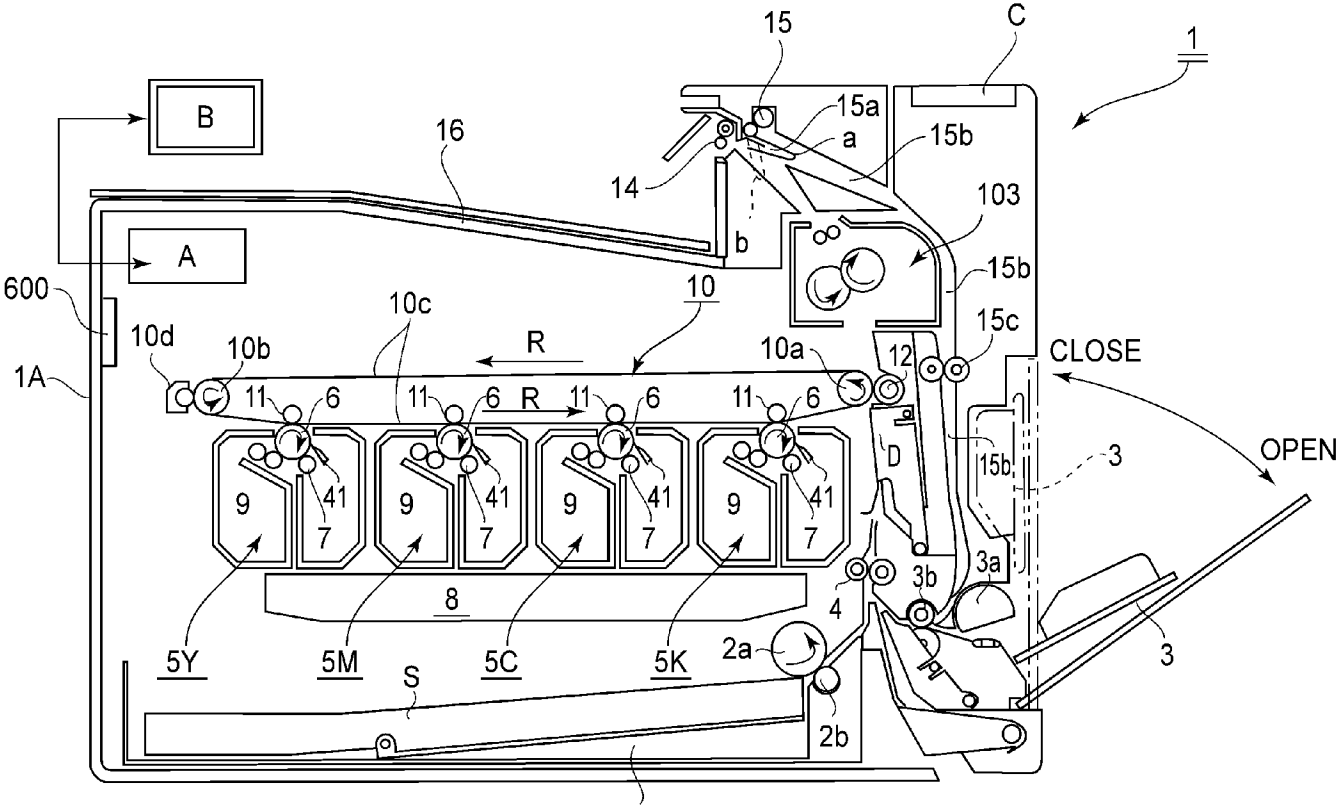
FIG. 3 is a schematic illustration of an image forming apparatus.

FIG. 3 is a schematic sectional view of an image forming apparatus 1. This image forming apparatus 1 is a four-color-basis, full-color laser beam printer (color image forming apparatus) using an electrophotographic process. That is, the image forming apparatus forms an image on a sheet (recording material such as a sheet, an OHP sheet, coated paper label paper) P on the basis of an electrical image signal inputted from an external host device B, such as a personal computer or an image reader, into a control circuit portion (control means or CPU) A.

The control circuit portion A transfers various pieces of electrical information between itself and the external host device B or an operating portion C, and effects integrated control of an image forming operation of the image forming apparatus 1 in accordance with a predetermined control program and reference table.

As an image forming portion 5, the image forming apparatus includes first to fourth (four) image forming stations (process cartridges) 5Y, 5M, 5C and 5K. The first to fourth image forming stations 5Y, 5M, 5C and 5K are successively arranged in parallel from a left side to a right side in FIG. 3 at a substantially central portion of an inside of the image forming apparatus 1.

Each image forming station includes the same electrophotographic process mechanism. Each of the image forming stations 5Y, 5M, 5C and 5K in this embodiment includes a rotation-drum-type electrophotographic photosensitive member (hereinafter referred to as a "drum") 6 as an image bearing member on which an image is to be formed. As process means actable on the drum 6, a charging roller 7, a cleaning member 41 and a developing unit 9 are provided.

The first image forming station 5Y accommodates a developer (toner) of yellow (Y) in a toner accommodating chamber of the developing unit 9. The second image forming station 5M accommodates a toner of magenta (M) in a toner accommodating chamber of the developing unit 9. The third image forming station 5C accommodates a toner of cyan (C) in a toner accommodating chamber of the developing unit 9. The fourth image forming station 5K accommodates a toner of black (K) in a toner accommodating chamber of the developing unit 9.

In an apparatus main assembly 1A, below the respective image forming stations 5Y, 5M, 5C and 5K, a laser scanner unit 8 as an image information exposure means for the respective drums 6 is provided. Further, in the apparatus main assembly 1A, on the respective image forming stations 5Y, 5M, 5C and 5K, an intermediary transfer belt unit 10 is provided.

The unit 10 includes a driving roller 10*a* provided in a right side in FIG. 3, a tension roller 10*b* provided in a left side in FIG. 3, and an intermediary transfer belt (hereinafter referred to as a belt) 10*c* as an intermediary transfer member extended and stretched between these rollers. Further, inside the belt 10*c*, first to fourth (four) primary transfer rollers 11 opposing the drums 6 of the respective image forming stations 5Y, 5M, 5C and 5K are provided parallel to each other. An upper surface portion of each of the drums 6 of the image forming stations 5Y, 5M, 5C and 5K contacts a lower surface of the belt 10*c* in a position of the associated primary transfer roller 11. The contact portion is a primary transfer portion.

Outside a curved portion of the belt 10*c* contacting the driving roller 10*a*, a secondary transfer roller 12 is provided. A contact portion between the belt 10*c* and the secondary transfer roller 12 is a secondary transfer portion. Outside a curved portion of the belt 10*c* contacting the tension roller 10*b*, a transfer belt cleaning device 10*d* is provided.

At a lower portion of the apparatus main assembly 1A, a sheet feeding cassette 2 is provided. The cassette 2 is constituted so as to be pullable from and insertable into the apparatus main assembly 1A in a predetermined manner.

In FIG. 3, in a right side in the apparatus main assembly 1, an upward sheet conveying path (vertical path) D is provided for conveying upward the sheet P picked up from the cassette 2. In the sheet conveying path D, in the order from a lower side to an upper side, a roller pair of a conveying roller 2*a* and a retard roller 2*b*, a registration roller pair 4, the secondary transfer roller 12, a fixing apparatus (device) 103, a double side flapper 15*a*, and a discharging roller pair 14 are provided. An upper surface of the apparatus main assembly 1*a* constitutes a discharge tray (discharged sheet stacking portion) 16.

In FIG. 3, in a right surface side of the apparatus main assembly 1A, a manual feeding portion (multi purpose tray) 3 is provided. The manual feeding portion 3 is capable of being placed in a closed state (retracted state) in which the manual feeding portion 3 is vertically raised and folded with respect to the apparatus main assembly 1A as indicated by a chain double dashed line during non use. During use, the manual feeding portion 3 is turned on its side, as indicated by a solid line, to be placed in an open state.

(1-1) Image Forming Sequence of Image Forming Apparatus

An operation for forming a full-color image is as follows.

A control circuit portion A starts an image forming operation of the image forming apparatus 1 on the basis of a print start signal. That is, in synchronism with image formation timing, each of the drums 6 of the first to fourth image forming stations 5Y, 5M, 5C and 5K is rotationally driven at a predetermined timing in the clockwise direction indicated by an arrow. Also the belt 10*e* is rotationally driven at a speed corresponding to the speed of the drum 6 in the counterclockwise direction (the opposite direction as the rotational direction of the drum 6) indicated by an arrow R. Also the laser scanner unit 8 is driven.

In synchronism with this drive operation, at each of the image forming stations 5Y, 5M, 5C and 5K, a surface of the drum 6 is electrically charged uniformly to a predetermined polarity and a predetermined potential by the charging roller 7 to which a predetermined charging bias is applied. The surface of each drum 6 is subjected to scanning exposure, by the laser scanner unit 8, to a laser beam modulated depending on an image information signal of an associated one of colors of Y, M, C and K. As a result, an electrostatic latent image depending on the image information signal of the associated color is formed on the surface of each drum 6. The formed electrostatic latent image is developed as a toner image (developer image) by a developing roller (developing member) of the developing unit 9. To the developing roller, a predetermined developing bias is applied.

By the electrophotographic image forming process operation as described, above, a Y image corresponding to a Y component of the full-color image is formed on the drum 6 of the first image forming station 5Y. The toner image is primary-transferred onto the belt 10*c* at the primary transfer portion of the image forming station 5Y. An M image corresponding to an M component of the full color image is formed on the drum 6 of the second image forming station 5M. The toner image is primary transferred superposedly onto the toner image of Y that has already been transferred on the belt 10*c* at the primary transfer portion of the image forming station 5M. A C image corresponding to a C component of the full color image is formed on the drum 6 of the third image forming station 5C. The toner image is primary transferred superposedly onto the toner images of Y and M that have already been transferred on the belt 10*c* at the primary transfer portion of the image forming station 5C. A K image corresponding to a K component of the full color image is formed on the drum 6 of the fourth image forming station 5K. The toner image is primary transferred superposedly onto the toner images of Y, M and C that have already been transferred on the belt 10*c* at the primary transfer portion of the image forming station 5K.

To each of the first to fourth primary transfer roller 11, at predetermined control timing, a primary transfer bias of an opposite polarity to a charge polarity of the toner and of a predetermined potential is applied. In this way, unfixed full-color toner images of Y, M, C and K are synthetically formed on the moving belt 10*c*. These unfixed toner images are conveyed by subsequent rotation of the belt 10*c* to reach the secondary transfer portion.

At each of the image forming stations 5, the surface of the drum 6 after the primary transfer of the toner image onto the belt 10*c* is wiped with a cleaning member (cleaning blade) 41 to remove a primary transfer residual toner, thus being subjected to a subsequent image forming step.

On the other hand, the sheets P in the cassette 2 are fed one by one by the feeding roller 2*a* and the retard roller 2*b* at a predetermined control timing, and the fed sheet P is conveyed to the registration roller pair 4. In the case of an operation in a manual feeding mode, the sheet P on the manual feeding tray 3 is fed by a feeding roller 3*a* and then is conveyed to the registration roller pair 4 by a conveying roller pair 3*b*.

The sheet P is conveyed to the secondary transfer portion at a predetermined control timing by the registration roller pair 4. To the secondary transfer roller 12, at a predetermined control timing, a secondary transfer bias of an opposite polarity to a normal charge polarity of the toner is applied. As a result, in a process in which the sheet P is nipped and conveyed through the secondary transfer portion, the superposed four-color toner images on the belt 10*c* are collectively secondary transferred onto the surface of the sheet P.

The sheet P coming out of the secondary transfer portion is separated from the belt 10*c* to be conveyed into the fixing apparatus 103, and then the toner images are thermally fixed on the sheet P. The sheet P coming out of the fixing apparatus 103 passes through a lower side of the double-side flapper 15*a* held in a first attitude a indicated by a solid line, and then is discharged onto the discharge tray 16 by the discharging roller pair 14. A secondary transfer residual toner remaining on the surface of the belt 10*c* after the secondary transfer of the toner images onto the sheet P is removed from the belt surface by the transfer belt cleaning device 10*d*, and then the cleaned belt surface is subjected to a subsequent image forming step.

The sheet P, coming out of the fixing apparatus 103, which has already been subjected to image formation at its one (first) surface (side) is not discharged onto the discharge tray 16, but can also be subjected to double-side printing by being conveyed into a re-circulating conveying path 15*b* for effecting printing on another (second) surface (side) of the sheet P. In this case, the sheet P, coming out of the fixing apparatus 103, which has already been subjected to image formation at its one surface passes through an upper side of the double-side flapper 15*a* switched to a second attitude b indicated by a broken line, and then is conveyed toward the discharge tray 16 by a switch back roller 15.

Then, when a downstream end of the sheet P with respect to a conveyance direction reaches a position on the double-side flapper 15*a*, the double side flapper 15*a* is returned to the first attitude a, and at the same time, the switch-back roller 15 is reversely driven. As a result, the sheet P is reversely conveyed downward in the re-circulating path 15*b* to the registration roller pair 4 again via a conveying roller pair 15*c* and 3*b*. Thereafter, similarly as in the case of the operation in a one-side image forming mode, the sheet P which has already subjected to the double-side printing is conveyed through a path including the secondary transfer portion, the fixing apparatus 103 and the discharging roller pair 14, thus being discharged onto the discharge tray 16.

Incidentally, in this embodiment, as the image forming apparatus 1, the full-color laser beam printer including the plurality of drums 6 is used, but the present invention is applicable to also a fixing apparatus to be mounted into a monochromatic copying machine or printer. Therefore, the image forming apparatus in which the fixing apparatus of the present invention is to be mounted is not limited to the full-color laser beam printer.

(2) Structure of Fixing Apparatus

Figure 1:
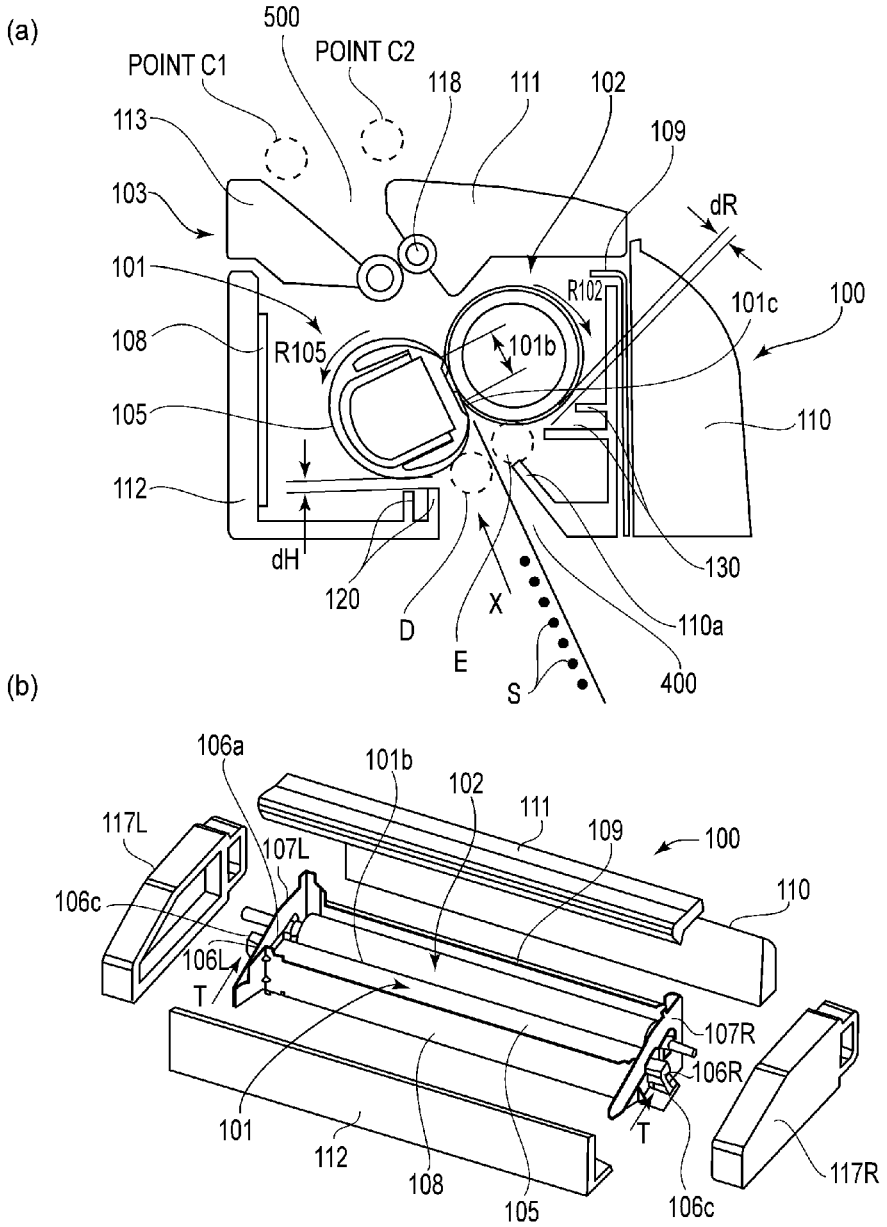
FIGS. 1(*a*) and 1(*b*) are a schematic illustration and an exploded perspective view, respectively, of a fixing apparatus.

Next, the fixing apparatus 103 will be described. FIG. 1(*a*) is a schematic sectional view of the fixing apparatus 103, and FIG. 1(*b*) is an exploded perspective view of the fixing apparatus 103. The fixing apparatus in this embodiment has a constitution in which a pair of rollers for forming a nip therebetween for heating and pressing the sheet while nip-conveying the sheet during fixing is provided. Specifically, a fixing apparatus of a belt (film) fixing type using a planar (thin plate-like) heater 101*a*, such as a ceramic heater as a heating source, is used. A heating apparatus of this type has been known by, e.g., JP A Hei 4 44075.

The fixing apparatus 103 is an elongated apparatus such that a direction parallel to a direction perpendicular to a conveyance direction (X) of the sheet P in a plane of a sheet conveying path at the nip is a longitudinal direction (widthwise direction). The fixing apparatus 103 roughly includes the fixing unit provided with the heating unit 101 and the pressing roller (pressing member) 102 and includes a casing 100 accommodating these members.

(2-1) Structure of Casing

In the casing 100, as shown in FIG. 1(*a*), an introducing opening (sheet introducing opening) 400 is formed in a position where the sheet is to be introduced, and a discharge opening (sheet discharge opening) 500 is formed in a position where the sheet is to be discharged. Further, the fixing belt 105 and the pressing roller 102 are disposed so that the introducing opening 400 is located below the discharge opening with respect to the direction of gravitation, and the apparatus in this embodiment has a constitution, which is a so-called a vertical-path-type apparatus, in which the sheet is conveyed from below to above with respect to the direction of gravitation.

Figure 2:
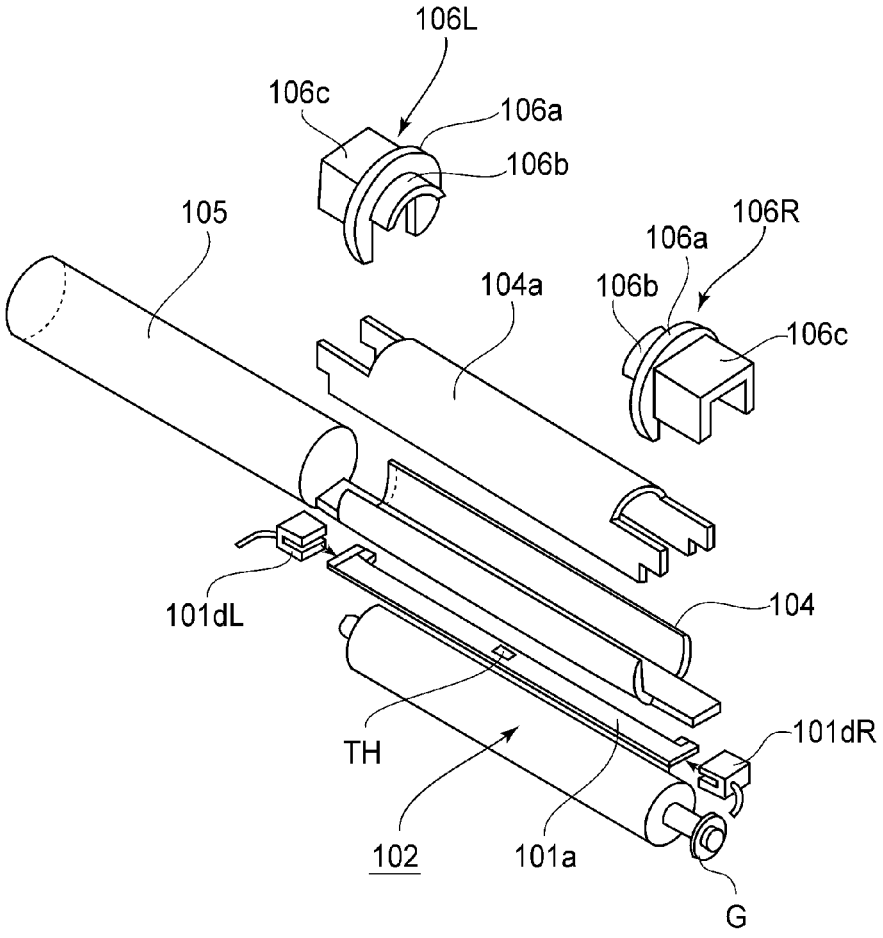
FIG. 2 is an exploded perspective view of a fixing unit.

FIG. 2 is an exploded perspective view of the heating unit 101. Incidentally, also the pressing roller 102 is illustrated.

The heating unit 101 is an assembled member including a heater holder 104, a planar heater 101*a*, an urging (pressing) stay 104*a*, the fixing belt 105 as a rotatable heating member to be rotated, flanges 106L and 106R located in end sides of the fixing belt 105 with respect to the widthwise direction of the fixing belt 105, and the like.

The heater holder 104 is an elongated member having an almost semi-circular trough shape in cross section, and is formed of a heat-resistant resin material, such as a liquid crystal polymer. The heater 101*a* is an elongated, planar, heat generating member, having a low thermal capacity, a ceramic heater that abruptly increases in temperature by electrical energy supply, and is provided and held along the heater holder 104. The urging stay 104*a* is an elongated rigid member having a U-shape in cross section, and is formed of metal such as iron, and is provided inside the heater holder 104. The fixing belt 105 is loosely engaged (fitted) externally with the assembled member of the heater holder 104, the heater 101*a*, and the urging stay 104*a*.

The flanges 106L and 106R are symmetrical molded members formed of a heat-resistant resin material, and are mounted symmetrically in longitudinal end sides of the heater holder 104*a*. The flanges 106L and 106R correspond to arcuate holding members 1 for holding the fixing belt 105 and for guiding rotation of the fixing belt 105. Movement of widthwise end portions of the fixing belt 105 in a widthwise direction is limited by the flanges 106L and 106R.

Each of the flanges 106L and 106R includes, as shown in FIG. 2, a flange portion 106*a*, a shelf portion 106*b* and a portion-to-be-urged 106*c*. The flange portion 106*a* is a member for limiting movement of the fixing belt 105 in a thrust direction by receiving an end surface of the fixing belt 105, and has an outer configuration larger than an outer configuration of the fixing belt 105. The shelf portion 106*b* is provided in an arcuate shape in an inner surface side of the flange portion 106*a* and holds the fixing belt end portion inner surface to keep the cylindrical shape of the fixing belt 105. The portion-to-be-urged 106*c* is provided in an outer surface side of the flange portion 106*a* and receives an urging force by an urging means (not shown).

(2-2-1) Structure of Fixing Belt

Figure 4:
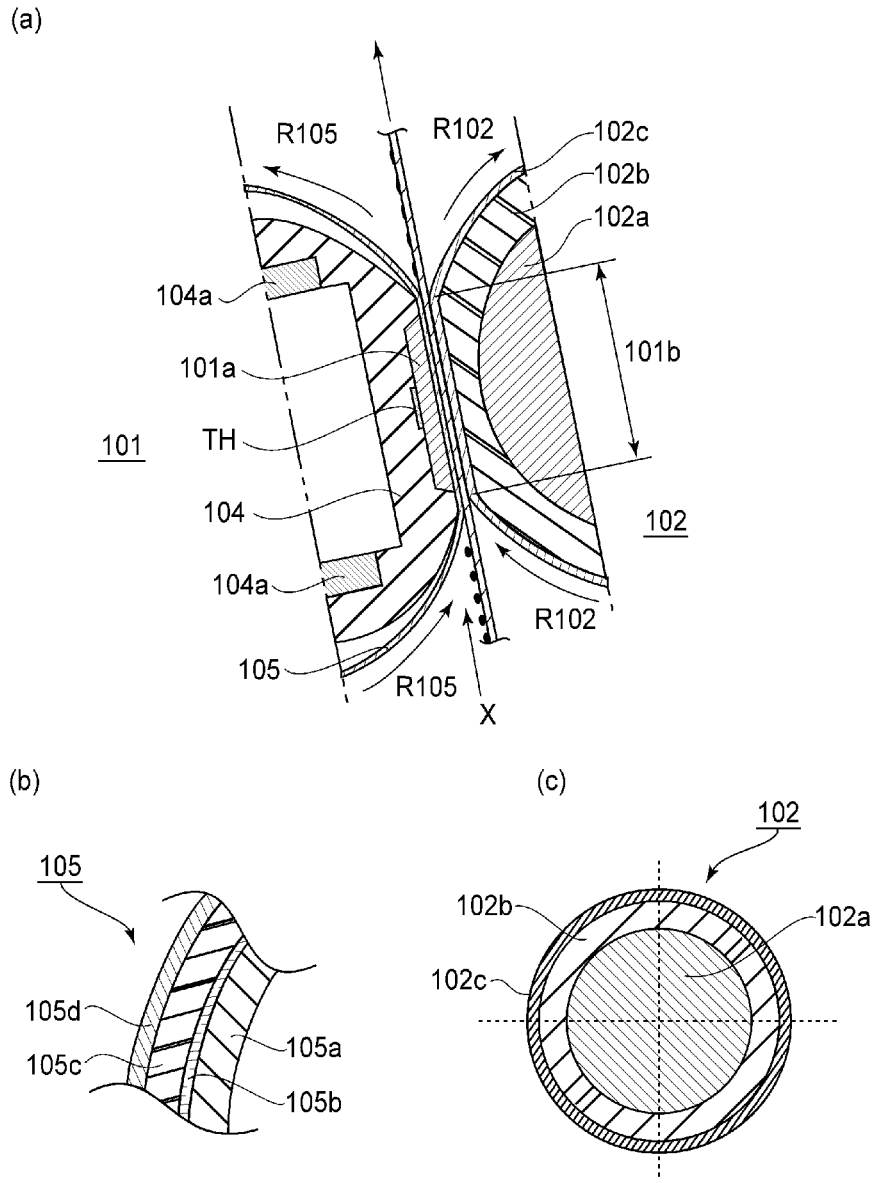
FIG. 4(*a*) is an enlarged view of a nip in FIG. 1(*a*), FIG. 4(*b*) is a schematic view showing a layer structure of a fixing belt, and FIG. 4(*c*) is a schematic view showing a layer structure of a pressing roller.
Figure 5:
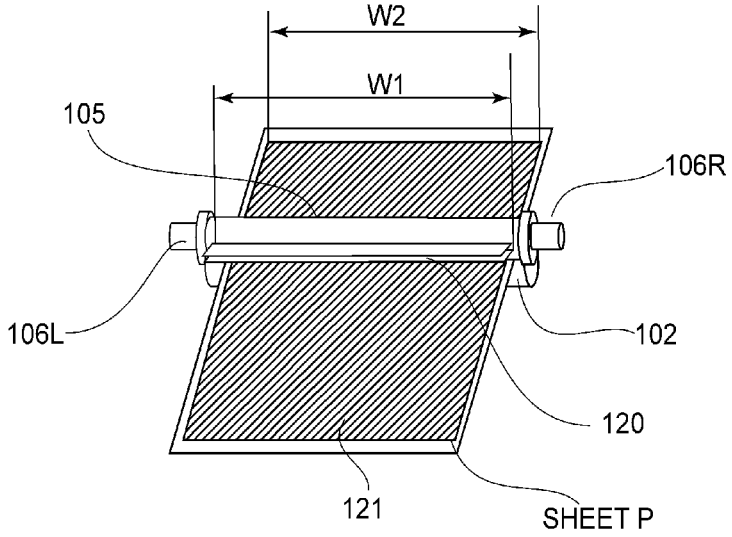
FIG. 5 is a perspective view showing a positional relationship between the fixing unit and a sheet.

FIGS. 4(*a*) and 4(*b*) are schematic views showing a layer structure of the fixing belt 105 in this embodiment. FIG. 4(*a*) is an enlarged view of a nip 101*b* in FIG. 1(*a*). The fixing belt 105 is a composite layer member in which an endless (cylindrical) base layer 105*a*, a primer layer 105*b*, an elastic layer 105*c* and a parting layer 105*d* are laminated. The fixing belt 105 is a thin and low thermal capacity member having flexibility as a whole.

The base layer 105*a* is formed of metal, such as SUS (stainless steel), and has a thickness of about 30 μm for withstanding thermal stress and mechanical stress. The primer layer 105*b* is formed on the base layer 105*a* by applying a primer in a thickness of about 5 mm.

The elastic layer 105*c* deforms when the toner image is press-contacted to the fixing belt 105, and performs the function of causing the parting layer 105*d* to hermetically contact the toner image. The parting layer 105*d* uses PFA resin material having excellent parting and heat-resistant properties in order to ensure a performance for preventing deposition of the toner and paper dust. The thickness of the parting layer 105*d* is about 20 μm from a viewpoint of ensuring heat conduction.

(2-3) Structure of Pressing Roller

Part (c) of FIG. 4 is a schematic view showing a layer structure of the pressing roller 102.

The pressing roller 102 is an elastic roller including a metal core 102*a* of aluminum or iron, an elastic layer 102*b* formed of a silicone rubber or the like, and a parting layer 102*c* for coating the elastic layer 102*b*. The parting layer 102*c* is formed of a fluorine-containing resin material such as PFA and is a tube coating.

The casing 100 includes, as shown in FIGS. 1(*a*) and 1(*b*), an elongated inner metal plate frame constituted by a base plate 109, a stay 108, a side plate 107L and another side plate 107R. Further, the casing 100 includes an elongated outer frame, of a heat-resistant resin material, constituted by a cover 110, a first upper cover 111, a front cover 112, a second upper cover 113, a side cover 117L and another side cover 117R. Incidentally, in FIG. 1(*b*), in order to prevent the drawing from being complicated, a part of components, such as the second upper cover 113, is omitted from illustration.

Figure 19:
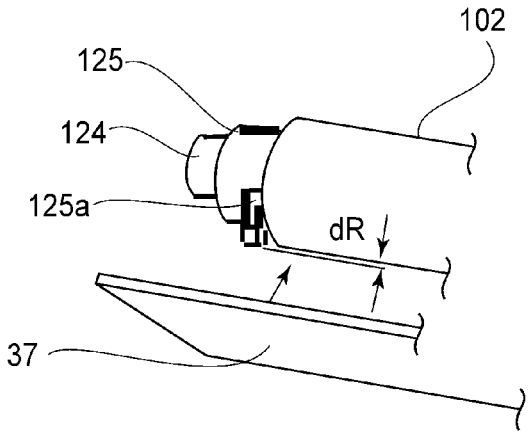
FIGS. 19(*a*) and 19(*b*) are partly enlarged views of the diffusion suppressing member and the fixing belt.
Figure 19:
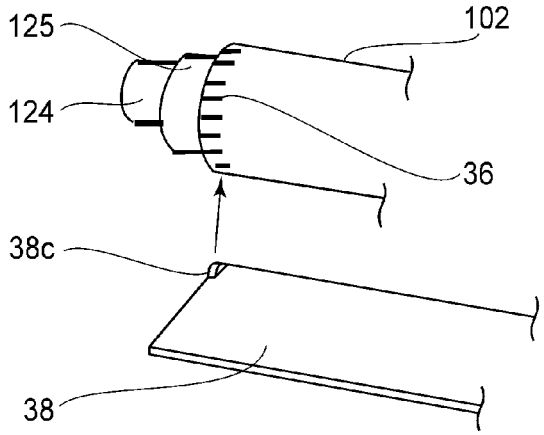

The pressing roller 102 is provided and rotatably supported between the side plate 107L and another side plate 107R of the inner frame via a bearing 125 (FIGS. 19(*a*) and 19(*b*)) as a holding member 2 in each of end sides of the metal core 102*a*.

The heating unit 101 is disposed, in parallel to the pressing roller 102, between the side plate 107L and another side plate 107R of the inner frame while opposing the pressing roller 102 on the heater 101*a* side.

Here, the flanges 106L and 106R in the end sides of the heating unit 101 are slidably engaged with guide holes (not shown), directed toward the pressing roller 102, formed in the side plates 107L and 107R in the end sides of the inner frame. Then, each of the flanges 106L and 106R in the end sides is urged by a predetermined urging force T (FIG. 1(*b*)) in a direction toward the pressing roller 102 by an urging means (not shown).

As a result, the fixing belt 105 is rotated by rotation of the pressing roller 102. That is, in this embodiment, the pressing roller 102 performs also the function of a driving roller (rotatable driving member) for rotationally driving the fixing belt 105.

By the above-described urging force, the entirety of the flanges 106L and 106R, the urging stay 104*a* and the heater holder 104 is moved in the direction toward the pressing roller 102. For that reason, the heater 101*a* is urged toward the pressing roller 102 via the fixing belt 105 by the predetermined urging force T, so that the nip 101*b* (FIG. 1(*a*) and FIG. 4(*a*)) having a predetermined width is formed between the fixing belt 105 and the pressing roller 102 with respect to the sheet conveyance direction (X).

(2-4) Fixing Sequence

The operation of a fixing sequence (fixing process) of the fixing apparatus 103 is as follows.

The control circuit portion A rotationally drives the predetermined roller 102 at point control timing in a rotational direction R102 in FIG. 1(*a*) at a predetermined speed. The rotational driving of the pressing roller 102 is performed by transmitting a driving force of a driving source (not shown) to a driving gear G (FIG. 2) integral with the pressing roller 102.

By the rotational driving of the pressing roller 102, at the nip 101*b*, a rotational torque acts on the fixing belt 105 due to a frictional force between 105 and the pressing roller 102. As a result, the fixing belt 105 is rotated around the heater holder 104 and the urging stay 104*a* by the pressing roller 102 at a speed substantially corresponding to the speed of the pressing roller 102 while sliding at its inner surface on the heater 101*a* in close contact with the heater 101*a*.

Further, the control circuit portion A starts electrical energy (power) supply from a power source portion (not shown) to the heater 101*a*. The electrical energy supply to the heater 101*a* is made via electrical energy supplying connectors 101*d*L and 101*d*R (FIG. 2) mounted on the heater 101*a* on end sides of the heater 101*a*. By this electrical energy supply, the heater 101*a* is quickly increased in temperature over an effective full length region. This temperature rise is detected by a thermistor TH as a temperature detecting means provided on a rear side (opposite from the nip 101*b*) of the heater 101*a*.

The control circuit portion A controls, on the basis of the heater temperature detected by the thermistor TH, electrical power to be supplied to the heater 101*a* so that the heater temperature is increased up to and kept at a predetermined target set temperature. The target set temperature in this embodiment is about 170° C.

In a fixing apparatus state described above, the sheet P on which unfixed toner images S are carried is conveyed from the secondary transfer portion side of the image forming portion to the fixing apparatus 103 side, and then is introduced into a nip entrance 101*c* (FIG. 1(*a*)) while being guided by a guide member 110*a* (FIG. 1(*a*)), so that the sheet P is nipped and conveyed through the nip 101*b*. To the sheet P, in a process in which the sheet P is nipped and conveyed through the nip 101*b*, heat of the heater 101*a* is applied via the fixing belt 105. The unfixed toner images S are melted by the heat of the heater 101*a* and are fixed on the sheet P by pressure applied to the nip 101*b*. The sheet P coming out of the nip 101*b* is sent to an outside of the fixing apparatus 103 by a fixing discharge roller pair 118 (FIG. 1(*a*)).

(3) Parting Agent Incorporated in Toner

Next, a parting agent incorporated (contained) in the toner S, i.e., a wax in this embodiment will be described.

There is a fear that a phenomenon called offset is caused, in which the toner S is transferred onto the fixing belt 105 during fixing, and such an offset phenomenon leads to a factor which causes a problem such as an image defect.

Therefore, in this embodiment, the wax is incorporated into the toner S. That is, during the fixing, the wax bleeds from the toner S. As a result, the wax melted by heating is present at an interface between the fixing belt 105 and the toner image on the sheet P, so that it becomes possible to prevent the offset phenomenon (parting action).

Incidentally, also a compound containing a molecular structure of the wax is referred herein to as the wax. For example, such a wax is obtained by reacting a resin molecule of the toner with a wax molecular structure. Further, as a parting agent, other than the wax, it is also possible to use another substance, such as a silicone oil, having a parting action.

In this embodiment, paraffin wax is used and a melting point Tm of the wax is about 75° C. In the case where the heater temperature at the nip 101*b* is kept at the target set temperature of 170° C., the melting point Tm is set so that the wax in the toner S is instantaneously melted to bleed out to an interface between the toner image and the fixing belt 105.

When the wax is melted, a part of the wax, such as a low-molecular-weight component of the wax, is vaporized (volatilized). Although the wax is constituted by a long chain molecular component, the length of the component is not uniform and has a certain distribution. That is, it would be considered that the wax contains a low-molecular-weight component having a short chain and a low boiling point and a high-molecular-weight component having a long chain and a high boiling point and that the low-molecular-weight component as a part of the wax is vaporized.

The vaporized wax component is condensed by being cooled in the air, so that fine particles (dust) of several nm to several hundred nm in particle diameter can be present immediately after the condensation. However, it is assumed that most of the condensed wax component forms the fine particles of several nm to several ten nm in particle diameter. This dust is a wax component, and therefore has an adhesive property, so that there is a fear that the dust is deposited in positions inside the image forming apparatus 1 to cause a problem. For example, when the dust is fixed and deposited on the fixing discharge roller pair 118 and the discharge roller pair 114 to generate contamination, there is a fear that the contamination is transferred onto the sheet P to adversely affect the image. Further, there is a fear that the dust is deposited on a filter 600 (FIG. 3) provided in an exhausting (heat exhausting) mechanism for exhausting ambient air at a periphery of the fixing apparatus 103 mounted in the image forming apparatus 1, thus causing clogging.

(4) Generated Particles (Dust) Resulting from Parting Agent with Fixing

According to study by the present inventors, it was found that most of the wax (parting agent) component (also referred to as the dust) which is vaporized (volatilized) during the fixing and which is then condensed is present in the neighborhood of the sheet introducing opening 400 (nip entrance 101*c*) of the fixing apparatus 103. Further, it was found that there was an acceleration of the phenomenon that in the neighborhood of the sheet introducing opening 400 (nip entrance 101*c*) of the fixing apparatus 103, the wax components (dusts) were increased in particle size by their mutual collision. This will be described in detail below.

(4-1) Property and Generation Position of Dust

Figure 6:
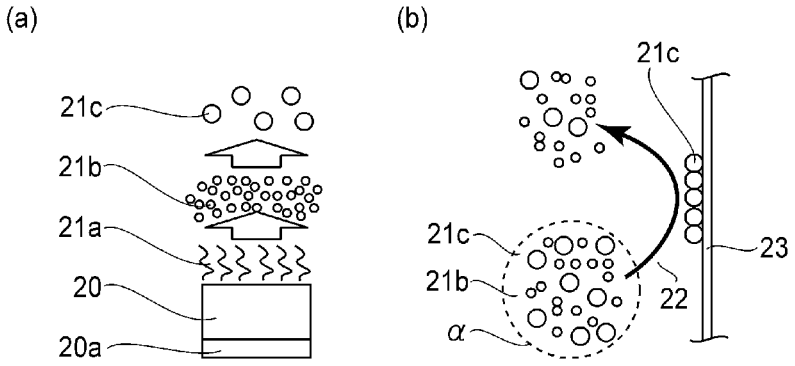
FIG. 6(*a*) is a schematic view showing a coalescence phenomenon of a dust, and FIG. 6(*b*) is a schematic view for illustrating a deposition phenomenon of the dust.

As a property of the dust resulting from the parting agent (wax), it is known that the dust components coalesce with each other to be increased in diameter and the dust is deposited on a solid matter in the air. FIGS. 6(*a*) and 6(*b*) are schematic views for illustrating these properties. As shown in FIG. 6(*a*), when a high boiling point substance 20 with a boiling point of 150-200° C. is placed on a heating source 20*a* and is heated to about 200° C., volatile matter 21*a* of the high boiling point substance 20 is generated. The volatile matter 21*a* is decreased in temperature to a boiling point temperature or less immediately after the volatile matter 21*a* contacts the air at a normal temperature, and therefore the volatile matter 21*a* is condensed in the air, thus being changed into fine particles (dust) 21*b* of several nm to several ten nm in particle size. This phenomenon is the same as the phenomenon that water vapor is changed into minute water droplets to generate fog when the temperature of the water vapor is below a dew point temperature.

Further, it has been known that the particles of dust 21*b* move in the air by the Brownian movement, and therefore mutually collide and coalesce to grow into the particles of the dust 21*c* having a larger particle size. This growth is accelerated when the dust more actively moves, in other words, when the ambient temperature increases. Further, the growth gradually slows down and stops when the dust has a certain particle size or more. This is presumably because when the dust is increased in particle size by the coalescence, the movement of the dust in the air by the Brownian movement becomes inactive.

Next with reference to FIG. 6(*b*), the case where the air a containing the minute dust 21*b* and the larger dust 21*c* moves toward a wall 23 along airflow 22 will be considered. At this time, the larger dust 21*c* is more liable than the minute dust 21*b* to be deposited on the wall 23 and is less liable to be diffused. This is presumably because the larger dust 21*c* has a larger force of inertia and vigorously collides against the wall 23. This phenomenon is similarly generated even in the case where the airflow speed is not more than 0.2 m/s, which is below the measurement limit of an anemometer, i.e., even in the case where the airflow speed is very slow. Therefore, it is understood that when the larger dust 21*c* is increased in particle size more and more, particularly, the fine particles of about several hundred nm are readily left in the fixing apparatus (most of the fine particles is deposited on the belt), and thus diffusion toward the outside of the fixing apparatus can be suppressed.

In this way, the dust has two properties including the property that the dust is increased in particle size by the coalescence and the property that the dust is liable to be deposited on a peripheral object (member) when the dust is increased in particle size. Incidentally, the ease coalescence of the dust depends on the components, the temperature, and the density of the dust. For example, when an easily adhesive component is softened at high temperatures or when the collision probability between dust particles is increased at a high density, the dust particles are liable to coalesce. Accordingly, it is understood that when the dust is increased in particle size, it is possible to suppress the diffusion of the dust toward the outside of the fixing apparatus in a state of the fine particles (particle size immediately after the condensation).

Figure 7:
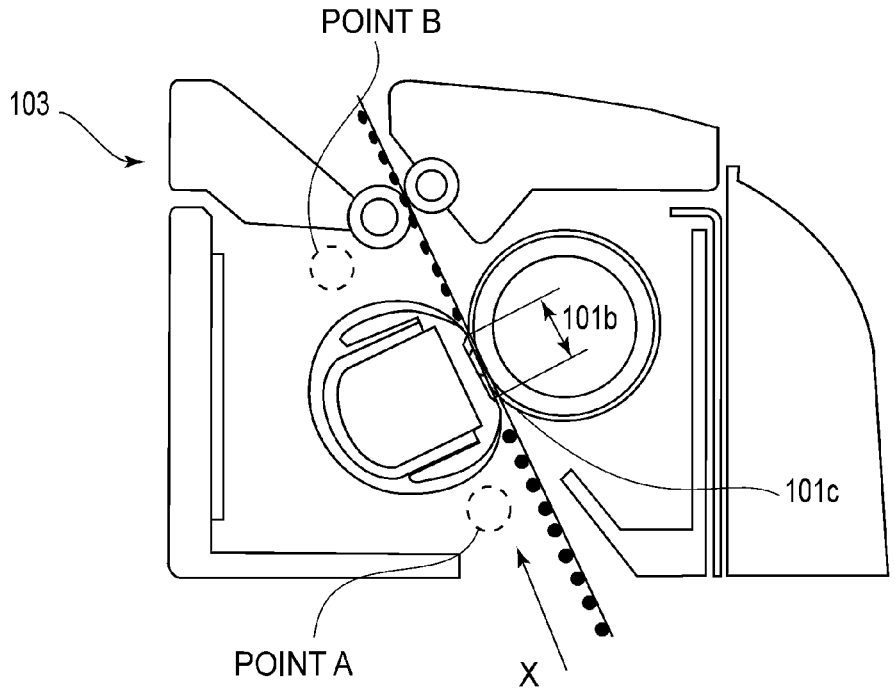
FIG. 7 is a schematic view for illustrating a generation point of the dust.
Figure 8:
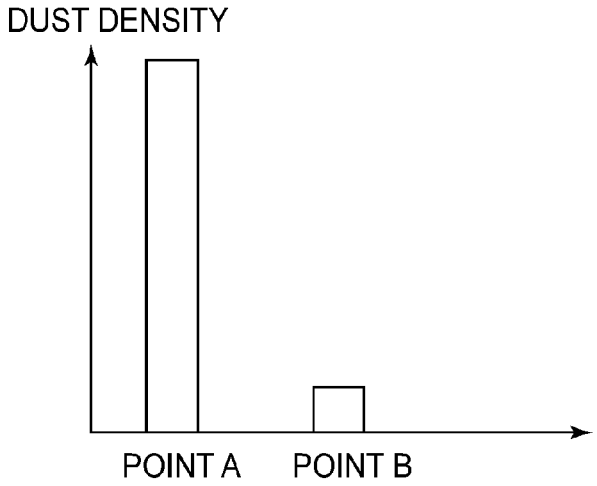
FIG. 8 is a graph showing a dust density at a periphery of the fixing belt.

Next, generation positions (points) of the dust will be described on the basis of FIGS. 7 and 8. FIG. 7 is different from FIG. 1(*a*) and shows a state in which the sheet P on which the toner images are carried is nipped and conveyed at the nip 101*b* and thus the dust is generated. In such a state (situation), when the dust density is measured at an entrance-side point A and an exit-side point B of the nip 101*b*, as shown in FIG. 8, the dust density at the point A was remarkably high. For measurement of the dust density, a high-speed response type particle size ("FMPS", mfd. by TSI Inc.) was used. The high-speed response type particle sizer (FMPS) is capable of measuring a number density (concentration) (particles/cm3) and a weight density (concentration) (μg/m3). In this embodiment, as described later, the number density (particles/cm3) of the fine particles of 5.6 nm or more and 560 nm or less in particle size (particles of a predetermined particle size) is used as the dust density.

The result (FIG. 8) shows that a dust generation position (point) is in the neighborhood of the introducing opening 400 (nip entrance 101*c*). As a predicted reason for this phenomenon, it would be considered that when the high-temperature fixing belt 105 contacts the toner images, the low-molecular-weight component of the wax is instantaneously volatilized and the volatilization is ended at about the time the component passes through the nip 101*b*.

(4-2) Dust Diffusion Path

A path along which the dust generated in the neighborhood of the introducing opening 400 (nip entrance 101*c*) is gradually diffused into the fixing apparatus will be described on the basis of a verification result of a hot airflow simulation shown in FIG. 9.

In this verification with respect to the heat and the airflow, it is assumed that the fixing belt 105 at a surface temperature of 170° C. is rotated in the counterclockwise direction R105 at a speed V, the pressing roller 102 is rotated in the clockwise direction R102 at the speed V, and the sheet P is moved upward in the figure at the speed V. For that reason, in this verification, ascending airflows (CD1 and CD2) due to natural convection generated at a periphery of the fixing belt 105 and the pressing roller 102, the airflow (RD1) at the belt surface generated with surface movement of the fixing belt 105 and the pressing roller 102, and the BB airflow (RD2) at the roller surface generated with surface movement of the pressing roller 102 are taken into consideration.

Figure 9:
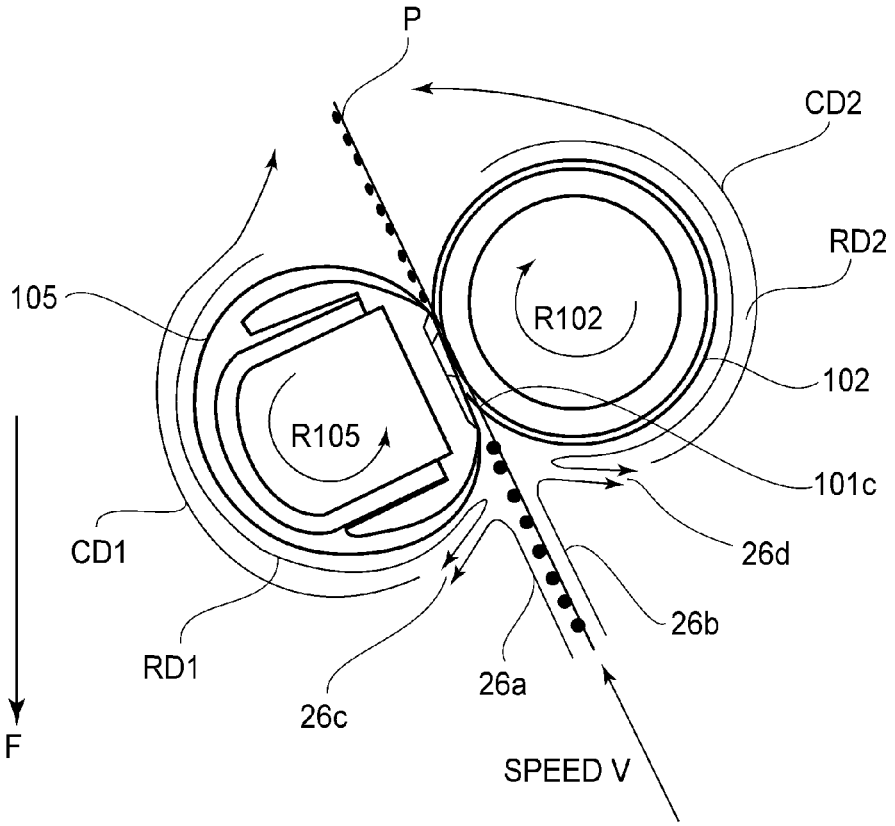
FIG. 9 is a schematic view for illustrating airflow at a periphery of the fixing belt and the pressing roller.

As shown in FIG. 9, it was confirmed that airflows 26*c* and 26*d*, which appear to lose a place to go at the nip 101*b* and to be issued from the nip 101*b*, are present.

It would be considered that the airflow 26*c* is the issued air which loses the place to go as a result of collision at the nip entrance 101*c* between the airflow RD1 and the airflow 26*a*, which is generated at the sheet surface with movement of the sheet surface. Further, similarly, it would be considered that the airflow 26*d* is the issued air which loses the place to go as a result of collision at the nip entrance 101*c* between the airflow RD2 and the airflow 26*b*, which is generated at the sheet surface with movement of the sheet surface.

Further, the airflow 26*c* merges with the airflow RD1 to form the airflow CD1, which is adjacent to the airflow RD1 and which flows in an opposite direction to the direction of the airflow RD1, i.e., the airflow which moves upward along the surface of the fixing belt 105. Similarly, the airflow 26*d* merges with the airflow RD2 to form the airflow CD2, which is adjacent to the airflow RD2 and which flows in an opposite direction to the direction of the airflow RD2, i.e., the airflow which moves upward along the surface of the pressing roller 102.

Incidentally, the airflows 26*c* and 26*d* were, as shown in FIG. 9, generated so as to move along the surfaces of the fixing belt 105 and the pressing roller 102, respectively, but this is presumed to be a result that these airflows are drawn by the natural convection moving upward in the neighborhood of the surfaces of the fixing belt 105 and the pressing roller 102.

Figure 10:
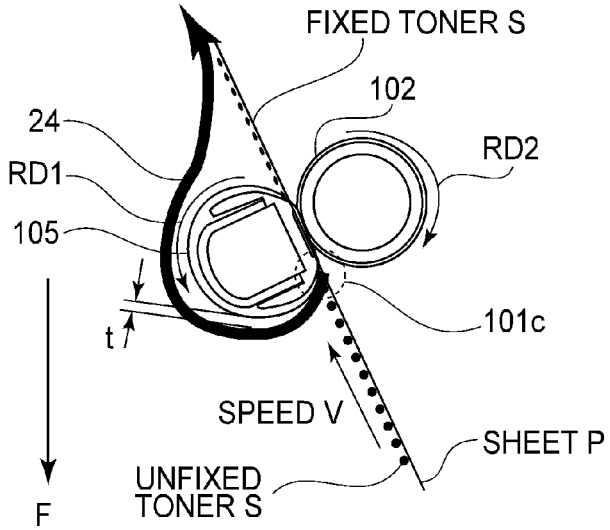
FIG. 10(*a*) is a schematic view showing a passing path of the dust during passing of an almost central portion of the sheet through the nip, and FIG. 1(*b*) is a schematic view showing a passing path when a trailing end of the sheet enters the nip.
Figure 10:
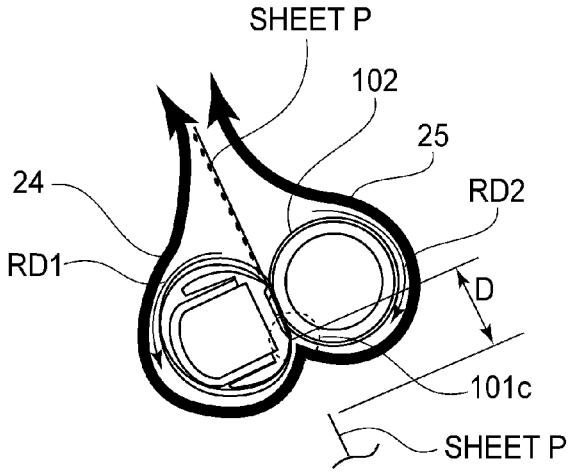

FIG. 10(*a*) shows a state in which the particles (dust) generated in the neighborhood of the introducing opening 400 (nip entrance 101*c*) in the fixing belt 105 side of the sheet P gradually flows along a path 24 by the airflows 26*c* and RD1 shown in FIG. 9. This path 24 represents a path along which phantom particles of zero in weight gradually flow when the phantom particles are generated at the nip entrance 101$c$. This method is used for studying an airflow path on the basis of the airflow simulation result.

According to the path 24 in FIG. 10($a$), the phantom particles (corresponding to the dust) generated in the neighborhood of the introducing opening 400 (nip entrance 101$c$) move in the clockwise direction along the surface of the fixing belt 105 and pass through a gap in the neighborhood of the fixing discharge roller pair 118 (FIG. 1($a$)), and then move upward along the sheet P. That is, it was found that the dust generated at the nip entrance 101$c$ passes through the gap belt the fixing belt 105 and the casing 100 and moves upward, and then is gradually diffused to the outside of the fixing apparatus. Further, as shown in FIG. 10($b$), the sheet P entering the nip entrance 101$c$ keeps a predetermined sheet interval D during continuous sheet passing. That is, there is a time when there is no sheet in the neighborhood of the nip entrance 101$c$, and therefore at that time, the dust generated on the image surface side of the sheet P passes through the sheet interval D to get out of the sheet P toward the pressing roller 102. The dust gets out of the sheet P carried by the airflows 26$d$ and CD2 in FIG. 9 and then is gradually diffused into the inside of the fixing apparatus along a path 25 shown in FIG. 10($b$). The presence of the airflow along the path 25 was confirmed by the airflow simulation similarly as in the case of the path 24. Further, the fact that the dust is carried along the path 25 was confirmed by measuring the dust density in the neighborhood of the path 25 by using the high-speed response type particle sizer (FMPS).

In the above, the coalescence and deposition of the dust, the fact that most of the dust generation is positioned is the neighborhood of the introducing opening 400 (nip entrance 101$c$), and the fact that the generated dust gradually moves along the surfaces of the fixing belt 105 and the pressing roller 102 were described.

(5) Diffusion Suppressing Mechanism

When a diffusion suppressing measure against the dust inside the image forming apparatus 1 is studied, it is understood that the air containing the dust may preferably be left in the neighborhood of the fixing belt 105 and the pressing roller 102, i.e., in the neighborhood of the introducing opening 400 (nip entrance 101$c$). This is because as described above, this region is close to the dust generation positions, and therefore the dust density is high, and is also because the ambient temperature is high due to the surface heat of the fixing belt 105, and therefore the region is suitable for acceleration of the dust coalescence.

Specifically, when the flow of the dust is blocked, the dust cannot move the inside of the casing 100, so that the dust remains in regions D and E shown in FIG. 1($a$). The dust stagnated in these regions is high in temperature and density, and therefore the coalescence of the dust is quickly and efficiently advanced. Then, the dust increased in particle size by the coalescence is moved toward the fixing belt 105 and the pressing roller 102 by being carried by the upward airflow generated by the natural convection and the movement of the sheet P. The dust increased in particle size is capable of being deposited, but its amount is very small, and therefore the influence on the image falls within a level where it is practically negligible.

Therefore, the fixing apparatus 103 in this embodiment is provided, in its casing 103, with diffusion suppressing mechanisms (120 and 130). By providing such diffusion suppressing mechanisms, the dust density is made less than 70% of the dust density measured in the case of a constitution in which the diffusion suppressing mechanisms are not provided. This is because a measurement error is 30%. That is, in this way, when movement of at least a part of the airflows CD1 and CD2 (FIG. 9) can be suppressed, it becomes possible to make the problem of dust at a practical level negligible.

The dust density can be measured by the above-described high-speed response type particle sizer (FMPS). Specifically, as shown in FIG. 1($a$), the dust density was measured at a point C1 (position of 40 mm from the nip entrance in terms of a distance in a straight line) located in the neighborhood of the discharge opening (sheet discharge opening) 500 of the casing 100, which is an exit of the path 24 (FIGS. 10($a$) and 10($b$) along which the dust is capable of being diffused. Further, the measurement is made under the following condition. Specifically, under a condition such that A4-sized plain paper is fed by long edge feeding on the basis of a standard original having a 5% in print ratio, fixing is continuously effected for 11 minutes. Further, for 1 minute (from after 10 minutes to 11 minutes), the dust density is measured. A measured value was obtained by averaging the dust densities in 1 minute.

Incidentally, the measurement may also be made at a point C2 located in the neighborhood of the discharge opening (sheet discharge opening) 500 of the casing 100, which is an exit of the path 25 (FIG. 10($b$)) along which the dust is capable of being diffused. The point C1 is suitable for verifying the suppressing effect of the dust diffused along the path 24. The point C2 is suitable for verifying the suppressing effect of the dust diffused along the path 25.

Further, in this embodiment, the dust density refers to the number density (particles/$cm^3$) of the fine particles having a particle size (diameter) in a predetermined range, i.e., the fine particles of 5.6 nm or more and 560 nm or less in particle size. That is, the number density measured at the point C1 (C2) may desirably be less than 70% of the number density in the constitution in which the diffusion suppressing mechanism as employed in this embodiment is not provided. Incidentally, as the dust density, in place of the number density (particles/$cm^3$), the weight density ($\mu g/m^3$) may also be employed.

Specifically, the diffusion suppressing mechanism is provided in each of the heating unit 101 side and the pressing roller 102 side and will be described specifically below.

(5-1) Diffusion Suppressing Mechanism in Heating Unit Side (5-1-1) Structure of Diffusion Suppressing Mechanism in Heating Unit Side As shown in FIG. 1($a$), the diffusion suppressing mechanism in the heating unit 101 side of the apparatus includes a diffusion suppressing member 120, functioning as a suppressing portion, in the neighborhood of the introducing opening (sheet introducing opening) 400 of the casing 100. Specifically, the diffusion suppressing member 120 consisting of a plurality of plate-like members (rib members) is provided so as to extend upward from a lower surface of the cover 112 of the casing 100. The diffusion suppressing member 120 is molded integrally with the cover 112.

Further, the diffusion suppressing member 120 is extended from the cover 112 so that the position of its end (uppermost portion) is located in a region of 0.5 mm or more and 3.5 mm or less from the surface of the fixing belt 105. Further, each of the rib members of the diffusion suppressing member 120 has a rectangular parallelopiped shape and is disposed in a range of 8 mm at an interval of 3 mm with respect to a direction (horizontal direction in FIG. 1($a$)) perpendicular to the extension direction. Incidentally, the disposition range may preferably be about 20 mm in the case where there is a sufficient disposition space. Further, the topmost ends of the rib members of the diffusion suppressing member 120 with respect to the extension direction from the cover 112 are located so as to be inclined, with respect to a radial direction of the fixing belt 105 (direction perpendicular to a rotational axis direction of the fixing belt 105), toward a downstream side (toward the nip entrance 101*c*) with respect to a rotational direction of the fixing belt 105.

This is because by disposing the diffusion suppressing member 120 so as to establish such a proximity relationship (that the diffusion suppressing member 120 is positioned in the range of 3.5 mm from the surface of the fixing belt 105), a dust density can be provided of less than 70% of the dust density measured in the constitution in which the diffusion suppressing mechanism as in this embodiment is not provided. That is, when the movement of a part of the airflow CD1 (FIG. 9) can be suppressed, it becomes possible to reduce the problem of the dust to a practically negligible level.

Incidentally, the lower limit of 0.5 mm is set because there is a fear that the diffusion suppressing mechanism contacts the fixing belt 105 when the diffusion suppressing mechanism is brought further near to the surface of the fixing belt 105.

Further, a longitudinal width W1 of the diffusion suppressing member 120 may preferably be, as shown in a perspective view of a principal part of the fixing apparatus (in which members such as the cover 112 constituting the casing 100 are omitted from illustration), set so as to be wider than a width W2 of a passing region of a toner image 121 on the sheet P. Incidentally, the width W2 corresponds to a width (maximum image width) of a region in which when a maximum width sheet is usable in the image forming apparatus, the image is formable on the maximum width sheet. As a result, the diffusion suppressing member 120 establishes a positional relationship with the fixing belt 105 in which the fixing belt 105 is extended to outside of widthwise ends of a region in which the fixing belt 105 is contactable to the toner image 121.

Incidentally, in this embodiment, with respect to a gap G (dH in FIG. 1(*a*)) between the diffusion suppressing member 120 and the fixing belt surface when a lowering in dust density at the point C1 was verified by stepwisely narrowing the gap G in the order of 4.0 mm, 3.5 mm, 2.5 mm, 2.0 mm and 1.5 mm, the above-described condition was able to be satisfied when the gap G was 3.5 mm or less.

Therefore, in this embodiment, the diffusion suppressing member 120 is provided so that the gap G is 2.5 mm.

(5-1-2) Disposition Range of Diffusion Suppressing Mechanism in Heating Unit Side Next, the disposition range of the diffusion suppressing member 120 will be described based on a schematic sectional view of the fixing apparatus shown in FIG. 11. The diffusion suppressing member 120 may preferably be, as described above, provided in the neighborhood of the dust generating region, i.e., in the neighborhood of the introducing opening 400 (nip entrance 101*c*) of the casing 100. This is because with a distance closer to the dust generating region, the dust density is higher, and thus the above-described coalescence effect is enhanced more.

However, when the diffusion suppressing member 120 is brought excessively near to the nip entrance 101*c*, the airflow 26*c* shown in FIG. 9 becomes strong, and therefore there is a fear that the airflow 26*c* flows out from the discharge opening 500 of the casing 100 through the spacing dH (FIG. 1(*a*)). That is, the dust entering the casing 100 is drawn by the above-described upward (ascending) airflow CD1 (FIG. 9), so that before the dust components in the fine particle state coalesce with each other into large particles, the dust is quickly discharged to the outside of the casing 100.

In order to avoid such a phenomenon, the spacing dH may preferably be narrowed as small as possible, but there is practically a limit. Therefore, in this embodiment, the diffusion suppressing member 120 may preferably be disposed, in a range L1 shown in FIG. 11, so as to be closer to the nip entrance 101*c* as shown in FIG. 1(*a*).

Incidentally, the range L1 can be defined by two intersection points 105*e* (intersection point A) and 105*f* (intersection point B) where a rectilinear line H which passes through a rotation center 105*g* of the fixing belt 105 and which is substantially parallel to a sheet conveyance direction X intersects with an outer circumference of the fixing belt 105. That is, the range L1 is a region on the outer circumference of the fixing belt 105 from the intersection point 105*e* to the intersection point 105*f* along the rotational direction R105 of the fixing belt 105.

When the diffusion suppressing member 120 establishes a positional relationship such that the diffusion suppressing member 120 opposes the fixing belt 105 in the range L1, it is possible to suppress the flowing out of the dust, caused by the airflow 26*c*, from the discharge opening 500 of the casing 100. Further, the reason why a region from the nip exit to the intersection point 105*e* is excluded is that conveyance of the sheet P is not prevented.

Figure 11:
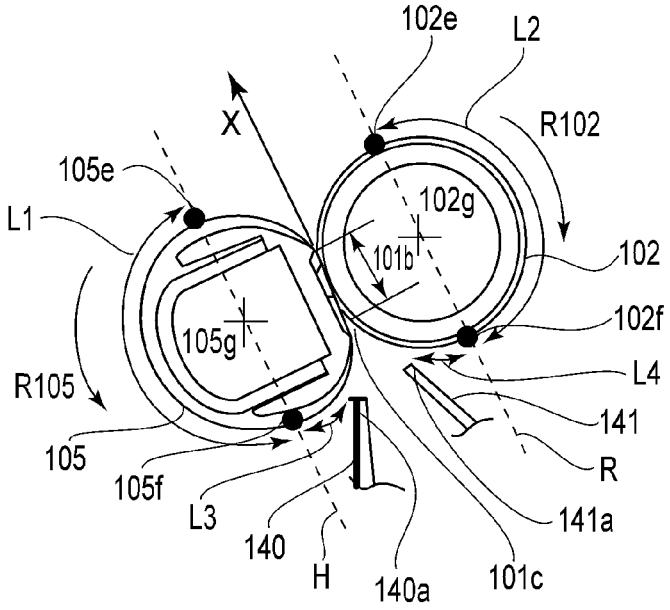
FIG. 11 is a schematic view for illustrating a position where a diffusion suppressing member is provided.
Figure 14:
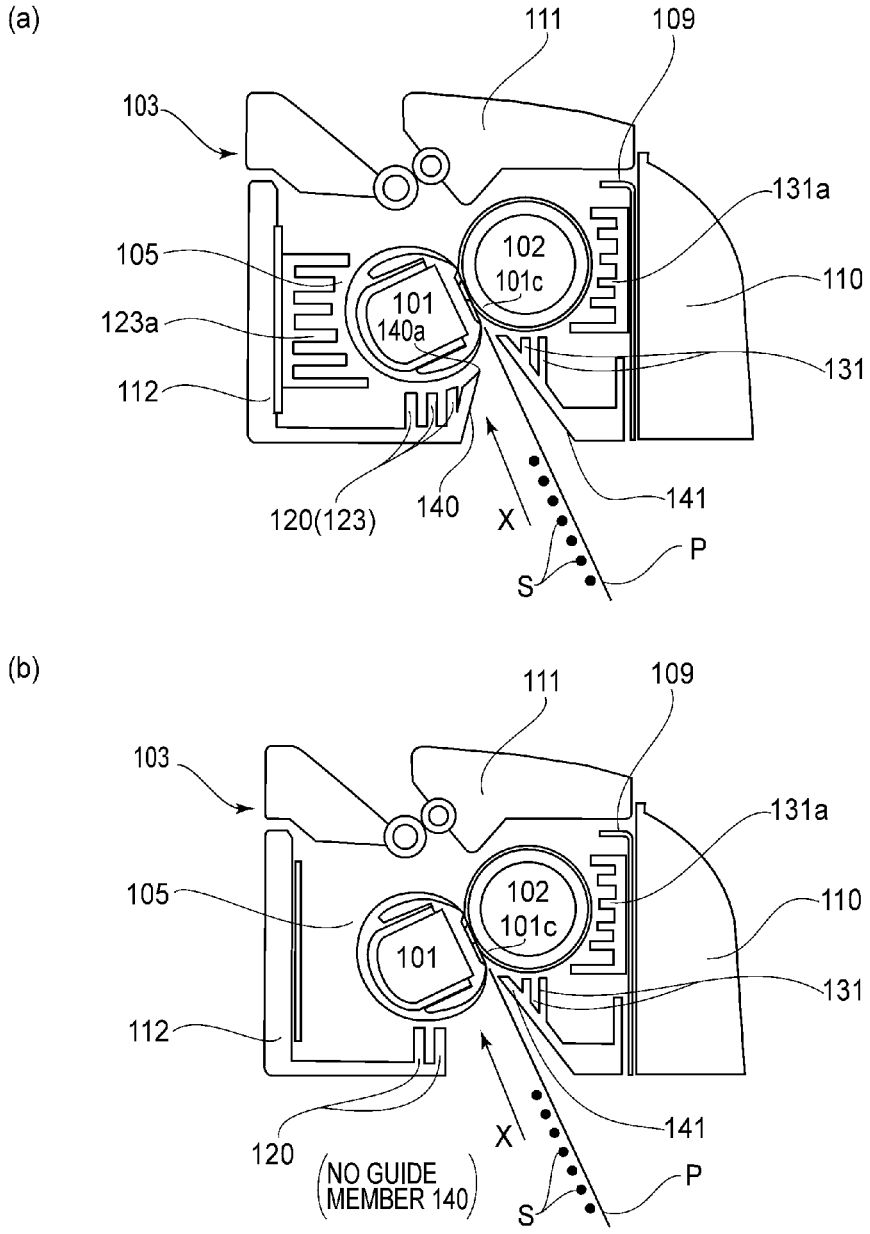

Incidentally, as shown in FIG. 11, in the case where an end of a guide member 140 for guiding the sheet P to the nip entrance 101*c* is located in the neighborhood of the nip entrance 101*c*, in a range L3 on the fixing belt 105 connecting from its end portion 140*a* of the intersection point 105*f*, the diffusion suppressing member may preferably be disposed to establish the positional relationship such that the diffusion suppressing member opposes the fixing belt 105 (FIGS. 14(*a*) and 14(*b*)).

This is because the end portion of the guide member 140 is located in the neighborhood of the nip entrance 101*c* and therefore the airflow 26*c* shown in FIG. 9 is liable to flow into the casing 100 together with the dust. In order to prevent such flowing in, as shown in FIG. 14(*a*), it is preferable that the guide member 140 is provided with a plurality of diffusion suppressing members 123 at a predetermined interval (3 mm) along the rotational direction of the fixing belt 105, and these diffusion suppressing members 123 are disposed so as to constitute air resistance against the airflow 26*c*.

Further, as shown in FIG. 14(*a*), when a plurality of diffusion suppressing members 123*a* are provided at a predetermined interval (3 mm) along the rotational direction of the fixing belt 105 in a left side of the fixing belt 105, a dust flow out suppressing effect can be enhanced, thus being further preferable.

Incidentally, in an actual machine (fixing apparatus), the guide member 140 for guiding the sheet P to the nip entrance 101*c* may preferably be not provided as shown in FIG. 14(*b*) in order to avoid friction of the image or the like. Incidentally, although not illustrated, in the case where a guide member 141 is not provided but only the guide member 140 is provided, as shown in FIG. 14(*a*), a constitution in which the diffusion suppressing members 123 and 123*a* are provided and no diffusion suppressing mechanism is provided in the predetermined roller side may also be employed.

As described above, in the fixing apparatus in this embodiment, the dust density which was ⅕ of the dust density measured in the constitution in which the diffusion suppressing mechanism as in this embodiment is not provided was able to be realized.

Incidentally, in this embodiment, from the viewpoints of improvement in the heat dissipation property (increase in surface area) and ease of a resin mold, the diffusion suppressing members 120 (123, 123*a*) are provided at a plurality of positions at predetermined intervals, but may also be provided at a single position. That is, in this case, a single block-like diffusion suppressing member is provided with no spacing (e.g., a length of the diffusion suppressing member 120 with respect to the direction perpendicular to the extension direction is 40 mm), but also in such a constitution, a similar effect can be achieved.

Further, in this embodiment, the diffusion suppressing member 120 has a shape such that the diffusion suppressing member 120 is extended from the cover 112 toward the fixing belt 105, but such a shape may also be not necessarily employed. For example, a constitution in which a portion (member) closest to the introducing opening 400 of the cover 112 is caused to also function as the diffusion suppressing member may be employed. Also in this case, it is preferable that a gap G between the fixing belt 105 and the portion closest to the introducing opening 400 of the cover 112 is 0.5 mm or more and 3.5 mm or less.

(5-2) Diffusion Suppressing Mechanism in Pressing Roller Side (5-2-1) Structure of Diffusion Suppressing Mechanism in Pressing Roller Side As shown in FIG. 1(*a*), the diffusion suppressing mechanism in the pressing roller 102 side of the apparatus includes a diffusion suppressing member 130, functioning as a suppressing portion, in the neighborhood of the introducing opening (sheet introducing opening) 400 of the casing 100. Specifically, the diffusion suppressing member 130, consisting of a plurality of plate-like members (rib members), is provided so as to extend from the cover 110 of the casing 100 toward a side direction. The diffusion suppressing member 130 is molded integrally with the cover 112. Incidentally, in the neighborhood of the introducing opening 400 of the cover 110, a guide portion 110*a* for guiding entrance of the sheet P into the nip 101*b* is formed. Further, the diffusion suppressing member 130 is disposed in the neighborhood of an upstream side of the guide portion 110*a* with respect to the rotational direction (R102) of the pressing roller 102. Further, the diffusion suppressing member 130 is extended from the cover 110 so that a position of its end is located in a region of 0.5 mm or more and 3.5 mm or less from the surface of the pressing roller 102. Further, each of the rib members of the diffusion suppressing member 130 has a rectangular parallelopiped shape is disposed in a length of 20 mm at an interval of 3 mm with respect to a direction (vertical direction in FIG. 1(*a*)) perpendicular to the extension direction. Further, at least a part of the ends of the rib members of the diffusion suppressing member 130 with respect to the extension direction from the cover 110 is located so as to be inclined, with respect to a radial direction of the pressing roller 102 (direction perpendicular to a rotational axis direction of the pressing roller 102), toward a downstream side (toward the nip entrance 101*c*) with respect to a rotational direction of the pressing roller 102.

This is because by disposing the diffusion suppressing member 130 so as to establish such a positional relationship (that the diffusion suppressing member 130 is positioned in the range of 3.5 mm from the surface of the pressing roller 102), a dust density can be provided of less than 70% of the dust density measured in the constitution in which the diffusion suppressing mechanism as in this embodiment is not provided. That is, when the movement of a part of the airflow CD2 (FIG. 9) can be suppressed, it becomes possible to make the problem due to the dust to be at a practically negligible level.

Incidentally, the lower limit of 0.5 mm is set because there is a fear that the diffusion suppressing mechanism contacts the pressing roller 102 when the diffusion suppressing mechanism is brought further near to the surface of the pressing roller 102.

Incidentally, in this embodiment, with respect to a gap G (dR in FIG. 1(*a*)) between the diffusion suppressing member 130 and the pressing roller surface, when a lowering in dust density at the point C2 was verified by stepwisely narrowing the gap G in the order of 4.0 mm, 3.5 mm, 2.5 mm, 2.0 mm and 1.5 mm, the above-described condition was able to be satisfied when the gap G was 3.5 mm or less.

Therefore, in this embodiment, the diffusion suppressing member 130 is provided so that the gap G is 2.0 mm.

(5-2-2) Disposition Range of Diffusion Suppressing Mechanism in Pressing Roller Side Next, the disposition range of the diffusion suppressing member 130 will be described based on a schematic sectional view of the fixing apparatus shown in FIG. 11. The diffusion suppressing member 130 may preferably be, as described above, provided in the neighborhood of the dust generating region, i.e., in the neighborhood of the introducing opening 400 (nip entrance 101*c*) of the casing 100. This is because with a distance closer to the dust generating region, the dust density is higher, and thus the above-described coalescence effect is enhanced more.

However, when the diffusion suppressing member 130 is brought excessively near to the nip entrance 101*c*, the airflow 26*d* shown in FIG. 9 becomes strong, and therefore there is a fear that the airflow 26*d* flows out from the discharge opening 500 of the casing 100 through the spacing dR (FIG. 1(*a*)). That is, the dust entering the casing 100 is drawn by the above-described upward (ascending) airflow CD2 (FIG. 9), so that before the dust components in the fine particle state coalesce with each other into large particles, the dust is quickly discharged to the outside of the casing 100.

In order to avoid such a phenomenon, the spacing dR may preferably be narrowed as small as possible, but there is practically a limit. Therefore, in this embodiment, the diffusion suppressing member 130 may preferably be disposed, in a range L2 shown in FIG. 11, so as to be closer to the nip entrance 101*c* as shown in FIG. 1(*a*).

Incidentally, the range L2 can be defined by two intersection points 102*e* and 102*f* where a rectilinear line R which passes through a rotation center 102*g* of the pressing roller 102 and which is substantially parallel to the sheet conveyance direction X intersects with an outer circumference of the pressing roller 102. That is, the range L2 is a region on the outer circumference of the pressing roller 102 from the intersection point 102*e* to the intersection point 102*f* along the rotational direction R102 of the pressing roller 102.

When the diffusion suppressing member 130 establishes a positional relationship such that the diffusion suppressing member 130 opposes the pressing roller 102 in the range L2, it is possible to suppress the flowing out of the dust, caused by the airflow 26*d*, from the discharge opening 500 of the casing 100. Further, the reason why a region from the nip exit to the intersection point 102*e* is excluded is that conveyance of the sheet P is not prevented.

Incidentally, as shown in FIG. 11, in the case where an end portion 141*a* of a guide member 141 for guiding the sheet P to the nip entrance 101*c* is located in the neighborhood of the nip entrance 101*c*, in a range L4 on the pressing roller 102 connecting from its end portion 141*a* to the intersection point 102*f*, the diffusion suppressing member may preferably be disposed to establish the positional relationship such that the diffusion suppressing member opposes the pressing roller 102 (FIGS. 14(*a*) and 14(*b*)).

This is because the end portion 141*a* of the guide member 141 is located in the neighborhood of the nip entrance 101*c*, and therefore the airflow 26*d* shown in FIG. 9 is liable to flow into the casing 100 together with the dust. In order to prevent such flowing in, as shown in FIG. 14(*a*), it is preferable that the guide member 141 is provided with a plurality of diffusion suppressing members 131 at a predetermined interval (3 mm) along the rotational direction of the pressing roller 102, and these diffusion suppressing members 131 are disposed so as to constitute air resistance against the airflow 26*d*.

Further, as shown in FIG. 14(*a*), when a plurality of diffusion suppressing members 131*a* are provided at a predetermined interval (3 mm) along the rotational direction of the pressing roller 102 in a right side of the pressing roller 102, a dust flowing out suppressing effect can be enhanced, thus being further preferable.

As described above, in the fixing apparatus in this embodiment, the dust density which was ⅕ of the dust density measured in the constitution in which the diffusion suppressing mechanism as in this embodiment is not provided, was able to be realized.

Incidentally, in this embodiment, from the viewpoints of improvement in the heat dissipation property (increase in surface area) and ease of a resin mold, the diffusion suppressing members 130 (131, 131*a*) are provided at a plurality of positions at predetermined intervals, but may also be provided at a single position. That is, in this case, a single block-like diffusion suppressing member is provided with no spacing (e.g., a length of the diffusion suppressing member 130 with respect to the direction perpendicular to the extension direction is 40 mm), but also in such a constitution, a similar effect can be achieved.

Figure 12:
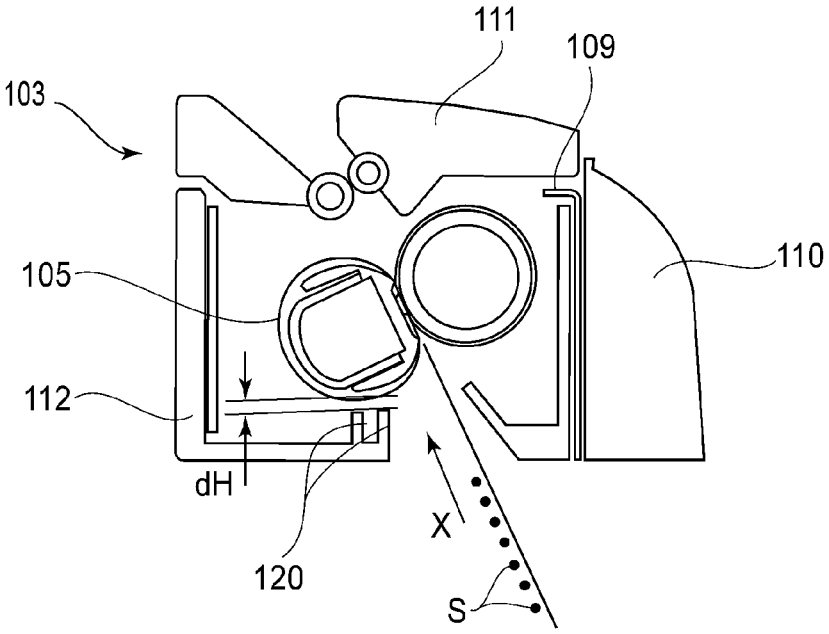
FIGS. 12 to 15 are schematic sectional views of a fixing apparatus.
Figure 13:
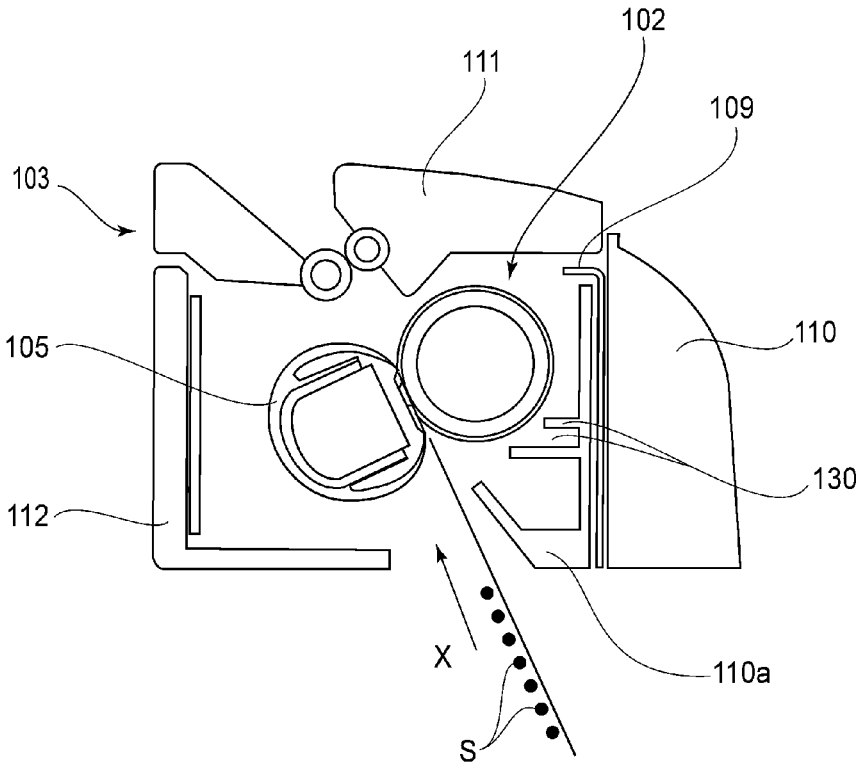

In the above-described embodiment, there is a constitution in which both of the heating unit and the pressing roller are provided with the diffusion suppressing member, but for example, a constitution in which the diffusion suppressing mechanism 120 is provided only in the heat unit side as shown in FIG. 12 may also be employed. Further, as shown in FIG. 13, there can be a constitution in which the diffusion suppressing mechanism 130 is provided only in the pressing roller side.

Incidentally, in this embodiment, the airflow CD1 is generated by the airflow 26*c* and the ascending natural convection airflow, and the airflow CD2 is generated by the airflow 26*d* and the ascending natural convection airflow. However, also in a constitution, in which the sheet conveyance direction in the fixing apparatus is the substantially horizontal direction, which is so-called long-edge passing, the airflows 26*c* and 26*d* are similarly present and merge with the airflow for cooling a peripheral portion of the fixing apparatus to form the airflows CD1 and CD2 in some cases. Also in such a constitution, it is possible to achieve a similar effect when the diffusion suppressing mechanism is provided.

Embodiment 2

Next, Embodiment 2 will be described with reference to FIGS. 15 to 20. Incidentally, a constitution of image forming portions of an image forming apparatus is the same as the constitution in Embodiment 1 and will be omitted from description. Further, also the mechanisms described in Embodiment 1 are represented by the same reference numerals or symbols and will be omitted from detailed description in this embodiment.

In this embodiment, a fixing method of the diffusion suppressing member is devised, so that a gap between the diffusion suppressing member and the fixing belt 105 or the pressing roller 102 is intended to be ensured with accuracy. This point is largely diffusion in the constitution from Embodiment 1, and other constituent elements are in accordance with those described in Embodiment 1. A description will be provided specifically below.

Specifically, in this embodiment, the diffusion suppressing the pressing member is positioned by being abutted against the fixing belt 105, the pressing roller 102 or their peripheral members, so that positional accuracy of the pressing member is enhanced. That is, a constitution for ensuring the spacings dR and dH, described in Embodiment 1, with accuracy will be described.

Figure 15:
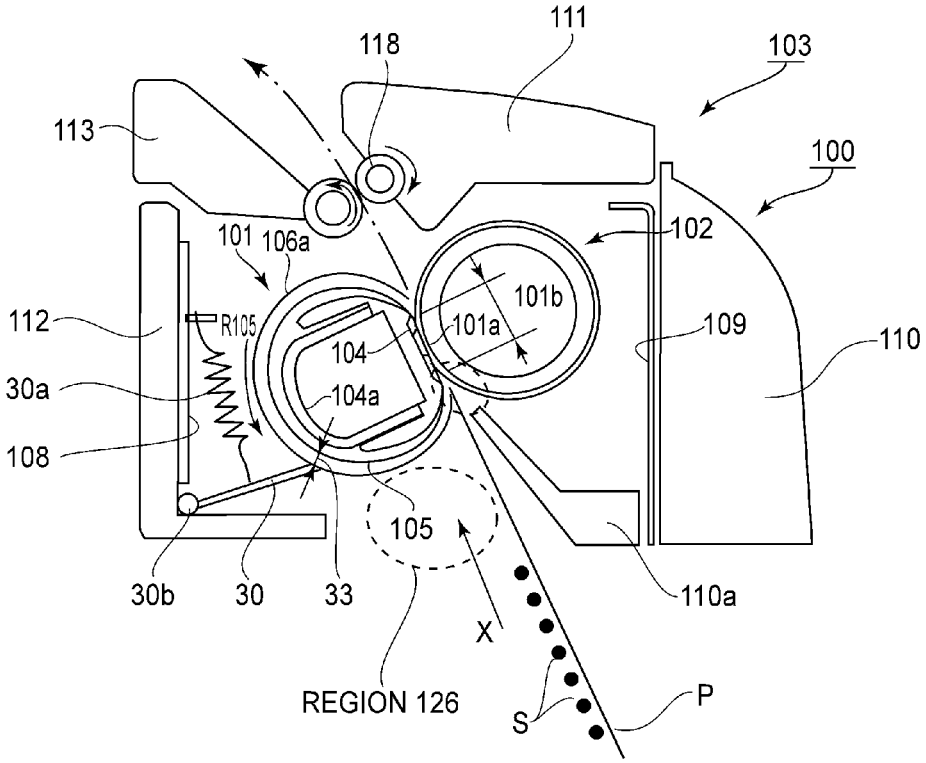

In the fixing apparatus 103 in this embodiment, as shown in FIG. 15, a plate member 30 functioning as the diffusion suppressing member is rotatably mounted on the cover 112 via a hinge 30*b*. Further, the plate member 30 is urged toward the fixing belt 105 by a spring 30*a* as an urging portion.

Figure 16:
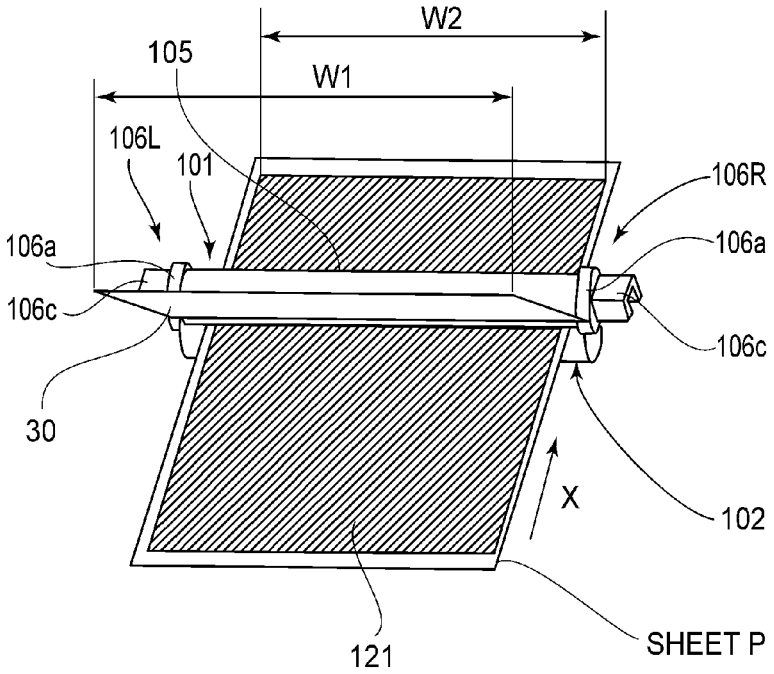
FIG. 16(*a*) is a perspective view showing a position relationship between the fixing unit and a sheet, and FIG. 16(*b*) is a partly enlarged view of a diffusion suppressing member and a fixing belt.
Figure 16:
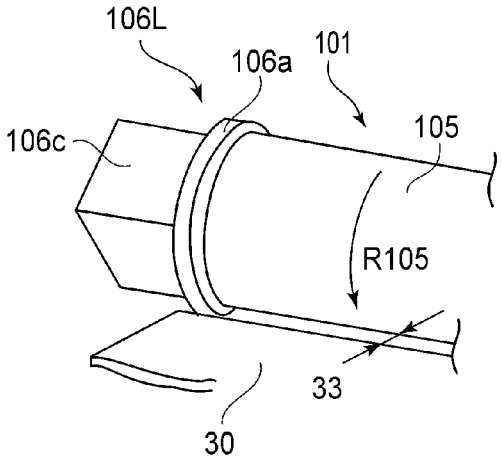

Further, longitudinal end portions of a leading edge of the plate member 30 are, as shown in FIG. 15 and FIG. 16(*b*), pressed against outer peripheral edges of flange portions 106*a* of flanges 106L and 106R as holding members.

As a result, between the leading edge of the plate member 30 and the fixing belt 105, a spacing (gap) 33 equal to a height of a stepped portion between the outer peripheral edge of the flange portion 106*a* and the outer surface of the fixing belt 105 is ensured (formed). That is, the flange portion 106*a* functions as a spacer means for providing the spacing 33, corresponding to a predetermined spacing dH, between the plate member 30 and the fixing belt 105. In this embodiment, the spacing 33 is set at 1.0 mm. This is because in order to suppress the flow of the dust, it is preferable that the spacing 33 is set so as to be narrower than the spacing t, described in Embodiment 1, to the extent possible.

Further, as shown in FIG. 16(*a*), similarly as in Embodiment 1, a width W1 of the plate member 30 is wider than a width W2 of a region in which the image is formable on the maximum width sheet. That is, a relationship of W1>W2 is satisfied.

In this way, the spacing 33 between the plate member 30 and the fixing belt 105 is ensured, so that even when the plate member 30 is thermally deformed, it becomes possible to prevent the plate member 30 from contacting the fixing belt 105. That is, it is ensured that the plate member 30 does not damage the fixing belt 105 in contact with the fixing belt 105.

In this embodiment, the plate member 30 is formed of a material, such as a metal plate, which is deformed less, but in the case where there is a fear that the fixing belt 105 vibrates to temporarily contact the plate member 30, the plate member 30 may also be formed of a resin material having a good sliding property.

Incidentally, as shown in FIG. 15, the plate member 30 is disposed so that the plate member 30 is inclined with respect to a radial direction of the fixing belt 105 (direction perpendicular to the rotational axis direction of the fixing belt 105) and so that an end of the plate member 30 is directed toward a downstream side of the rotational direction of the fixing belt 105.

Figure 20:
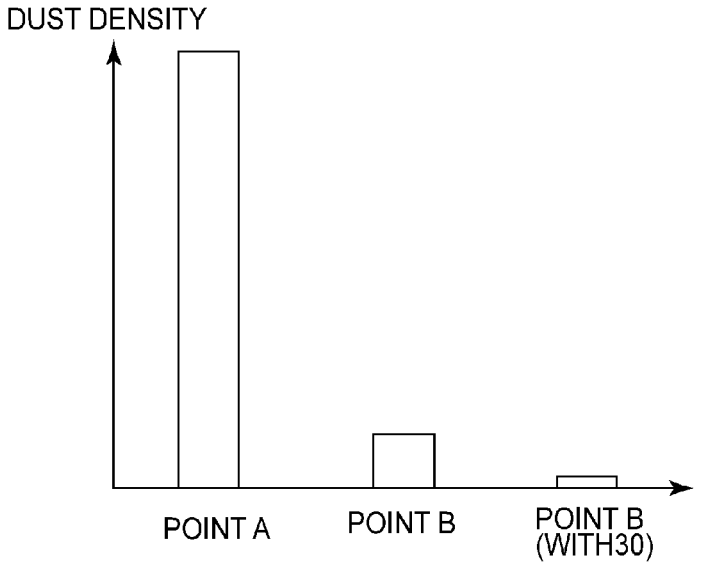
FIG. 20 is a graph showing a result of verification of a dust density.

This is because the dust flowing along the path 24 (FIGS. 10(*a*) and 10(*b*)) is guided in a direction in which the dust is spaced from the fixing belt 105. As a result, the dust is suppressed from entering the spacing 33. A graph shown in FIG. 20 shows a verification result, and data on the right hand side of the graph represents a dust density at the point B (FIG. 7) when the plate member 30 is provided. Compared with the case where there is no plate member 30 (the data in the a central portion of the graph of FIG. 20), the dust density at the point B was able to be suppressed to about ⅕. This result shows that the dust diffusion in the image forming apparatus is suppressed. In this embodiment, as a result of the suppression of the dust diffusion, it was also confirmed that degree of image contamination and the degree of filter clogging were reduced and therefore the results of filter clogging and image contamination were remedied.

The dust cannot move between the casing 100 and the fixing belt 105 by the plate member 30 and stagnates in a region 126 shown in FIG. 15. The dust stagnating in the region 126 is high in temperature and density, and therefore coalescence is quickly advanced. Then, the dust increased in size by the coalescence is carried, by the ascending airflow caused by the natural convection and the movement of the sheet P, toward the fixing belt 105 and then is deposited on the fixing belt 105. The deposited dust is melted by heat of the fixing belt 105 and then is deposited on the sheet P, but the minute dust is deposited on the sheet P, and therefore the influence on the image falls within a practically negligible level.

In this embodiment, by providing the spacer, the spacing dH can be made narrower than that in Embodiment 1, and therefore the diffusion suppressing member can be brought nearer to the nip entrance 101*c*. Accordingly, it becomes possible to improve the effect of promoting the coalescence of the dust by blocking the flow of the dust in the neighborhood of the nip entrance 101*c* where the dust density is highest.

Figure 18:
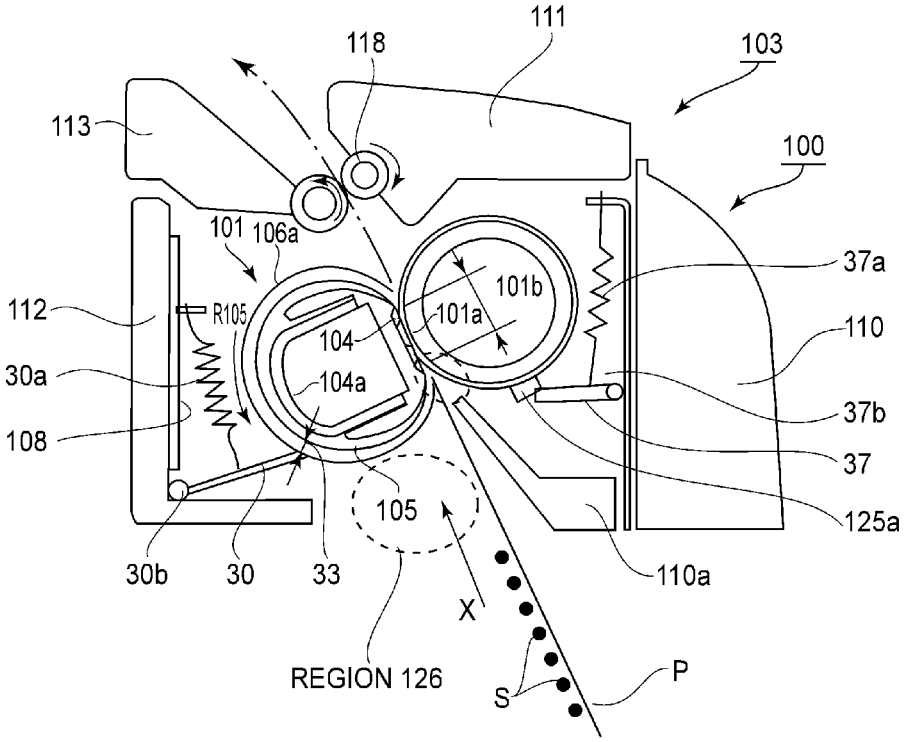
FIG. 18 is a schematic sectional view of the fixing apparatus.

Further, as shown in FIG. 18, a plate member 37 functioning as the diffusion suppressing member may also be provided in the neighborhood of the pressing roller 102. The plate member 37 is, similarly as the plate member s30, urged toward the pressing roller 102 by a spring 37*a* as the urging portion, and is abutted against a projection 125*a* provided on a bearing 125 as a holding member 125 for holding the pressing roller 102 as shown in FIG. 19(*a*). By employing such a constitution, accuracy of the spacing dR between the plate member 37 and the pressing roller 102 can be enhanced, and the spacing dR is 1.0 mm in this embodiment. In the embodiment shown in FIG. 18, it is possible to block also the path 25 (FIG. 10(*b*)) of the dust flowing at the periphery of the pressing roller 102, so that the dust contamination preventing effect can be further enhanced.

Incidentally, the plate member 30 is omitted and only the plate member 37 may also be used. Further, the diffusion suppressing member in Embodiment 1 may also be combined with the diffusion suppressing member in this embodiment.

Embodiment 3

Figure 17:
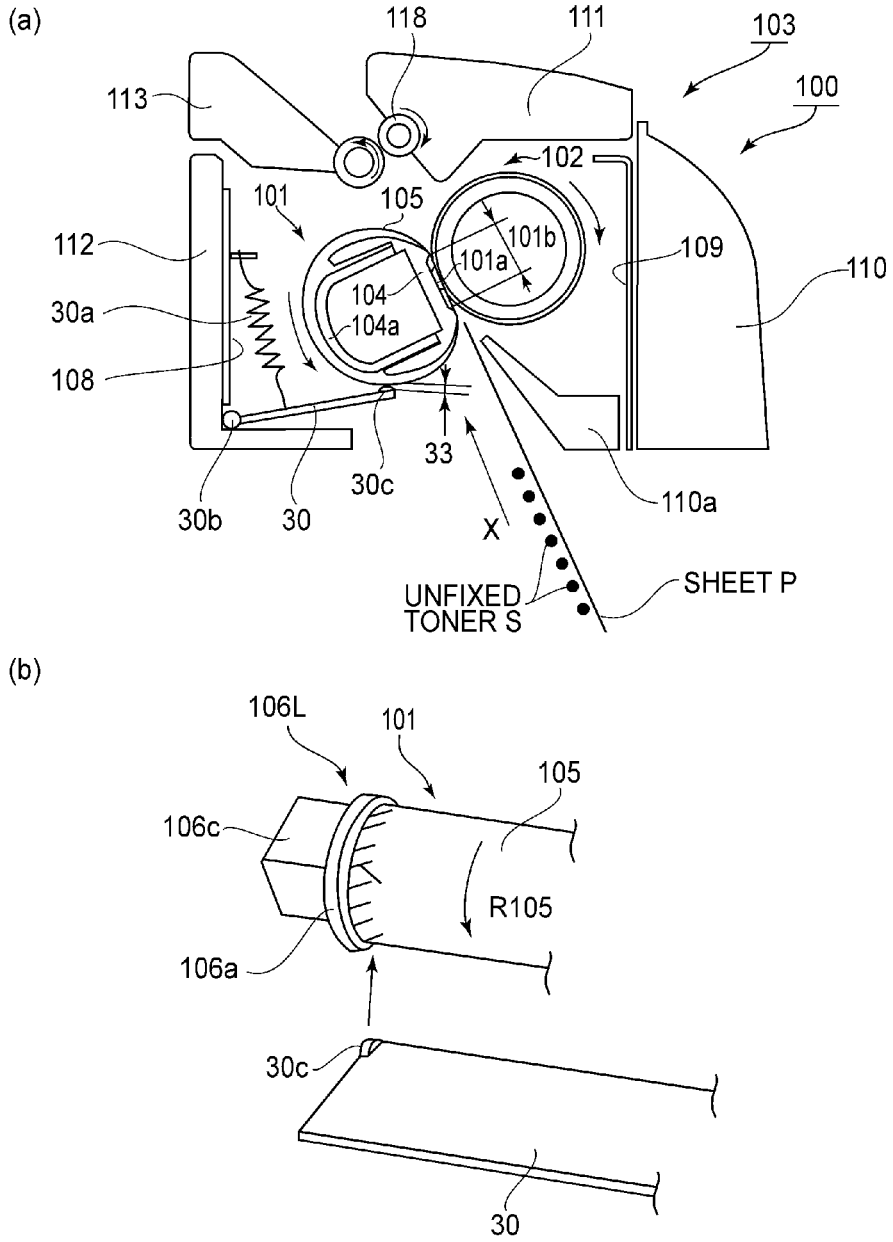
FIG. 17(*a*) is a schematic sectional view of a fixing apparatus, and FIG. 17(*b*) is a partly enlarged view of a diffusion suppressing member and a fixing belt.

Next, Embodiment 3 will be described with reference to FIGS. 17(*a*) and 17(*b*). Incidentally, a constitution of image forming portions of an image forming apparatus is the same as the constitution in Embodiment 1 and will be omitted from description. Further, also the mechanisms described in Embodiments 1 and 2 are represented by the same reference numerals or symbols and will be omitted from a detailed description in this embodiment.

In this embodiment, the constitution in Embodiment 2 is further devised. Specifically, as shown in FIGS. 17(*a*) and 17(*b*), two projections 30*c* as the spacer means are provided at longitudinal end portions, respectively, of a leading edge of the plate member 30 as the diffusion suppressing member. These two projections 30*c* are pressed against the outer surface of the fixing belt 105 at positions outside, with respect to the widthwise direction, the width W2 of the region in which the image is formable on the maximum width sheet (FIG. 17(*b*)). Incidentally, a region in which the projections 30*c* are abutted against the fixing belt 105 is such a region that an inner surface side is backed up by the shelf portion 106*b* (FIG. 2), so that the gap between the plate member 30 and the fixing belt 105 is stably ensured with accuracy. The shelf portion 106*b* performs, as described above, the function as the back-up member for maintaining the shape and rotation locus of the flexible fixing belt 105.

In this way, also in this embodiment, similarly as in Embodiment 2, the dust density can be stably suppressed.

Incidentally, such a constitution may also be applied to the diffusion suppressing member in the pressing roller 102 side of the apparatus. Specifically, as shown in FIG. 19(*b*), a constitution in which a plate 38 as the diffusion suppressing member is provided with projections 38*c* at longitudinal end portions and in which the projections 38*c* are to be abutted against longitudinal end portions of the pressing roller 102 is employed.

Embodiment 4

Next, Embodiment 4 will be described with reference to FIG. 21. Incidentally, a constitution of image forming portions of an image forming apparatus is the same as the constitution in Embodiment 1 and will be omitted from description. Further, also the mechanisms described in Embodiments 1, 2 and 3 are represented by the same reference numerals or symbols and a detailed description thereof will be omitted in this embodiment.

In Embodiments 1 to 3 described above, the density of the dust flowing out of the fixing apparatus is intended to be suppressed, but in this embodiment, a constitution in which the dust is prevented from flowing out of the fixing apparatus is employed. In the following, a description will be specifically provided based on the constitution in Embodiment 1.

As shown in FIG. 10(*a*), between the fixing belt 105 and the path 24, there is the spacing (gap) t where there is no dust. This spacing t is generated by the entrance of the airflow RD1 into the gap between the fixing belt 105 and the path 24. A line spaced from the fixing belt 105 by the distance t with respect to the radial direction is a boundary between the airflow RD1 and the airflow CD1, and in a region outside the boundary with respect to the radial direction, the dust generated at the nip entrance 101*c* is present.

Figure 21:
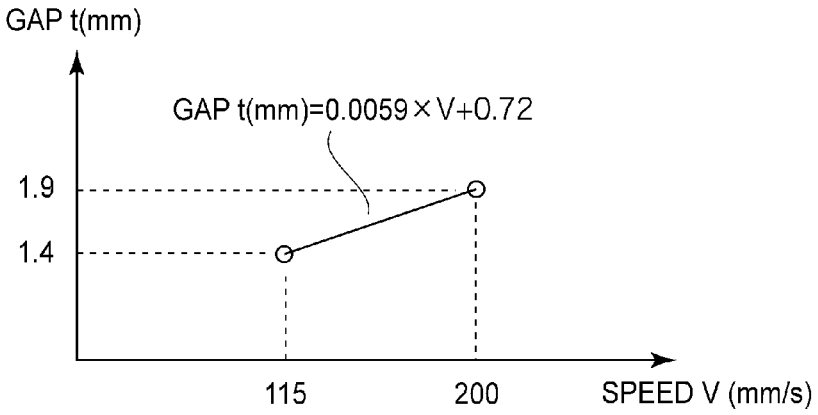
FIG. 21 is a graph showing a relationship between a gap and a peripheral speed.

Further, the spacing t depends on a speed V (peripheral speed of the fixing belt 105 and the pressing roller 102) as shown in FIG. 21. When the speed V is high, it is assumed that the airflow RD1 becomes strong to enlarge the spacing t.

Further, as shown in FIG. 10(*b*), the sheet P entering the nip entrance 101*c* is, when a plurality of sheets are continuously subjected to the fixing, introduced into the nip 101*b* with a predetermined interval. Specifically, the sheets P are successively conveyed while maintaining a predetermined distance (so called sheet interval) 12. Then, a period in which there is no sheet P is generated in the neighborhood of the nip entrance 101*c*, and in the period, the dust generated in the image surface side of the sheet P passes through the sheet interval D to reach the pressing roller 102 side in some cases. Such a dust is carried by the airflows 25*d* and CD2 shown in FIG. 9 and then is capable of being diffused to the outside of the fixing apparatus along the path 24 (FIG. 10(*b*)). This was confirmed by measuring the dust density in the neighborhood of the path 25 by the high-speed response type particle sizer (FMPS). Incidentally, also between the pressing roller 102 and the path 25, there is the spacing t where no dust is present.

The relationship between the spacing t and the speed V depends on the speed V similarly as in the case of the fixing belt, and is shown in FIG. 21.

In such a background, in order to block the dust flow, it is preferable that the spacing dR between the diffusion suppressing member 130 and the pressing roller 102 is set more severely.

The function of the diffusion suppressing members 120 and 130 is to prevent the dust flow completely by blocking the airflows CD1 and CD2 in FIG. 9. Therefore, the end of the diffusion suppressing member 120 may only be required to be located at a boundary between the airflows RD1 and CD1 or in a side of the apparatus closer to the fixing belt 105 than the boundary. Similarly, the end of the diffusion suppressing member 130 may only be required to be located at a boundary between airflows RD2 and CD2 or closer to the pressing roller 102 than the boundary.

Therefore, the present inventors conducted a verification (simulation) for setting the spacings dR and dH. FIG. 21 shows a verification result thereof.

In FIG. 21, the spacing (gap) t means a distance from the boundary between the airflows CD1 and CD2 to the outer surface of the fixing belt 101 or a distance from the boundary between the airflows CD1 and CD2 to the diffusion suppressing roller 102. Further, when a surface peripheral speed of the fixing belt 105 (or the pressing roller 102) is V, it was found that the following relationship may only be satisfied.

$$0.5 \leq dH \text{ (mm) (or } dR \text{ (mm))} \leq 0.005 \times V + 0.72$$

Here, the reason why the lower limit is 0.5 mm is, as described above, that the diffusion suppressing is prevented from contacting the fixing belt 105 or the pressing roller 102. Further, this is particularly effective when the peripheral speed V of the fixing belt 105 (or the pressing roller 102) is in a range of 115 m/s or more and 200 m/s or less.

In this embodiment, the peripheral speed V of the fixing belt 105 (or the pressing roller 102) is 200 m/s, and therefore it is understood that the spacing dH (or dR) may only be required to be set in a range of 0.5 mm or more and 1.9 mm or less. Therefore, in this embodiment, the spacings dH and dR were set at 1.9 mm as the upper limit.

By employing such a constitution, in this embodiment, the dust density at the point C1 can be made substantially zero (or not more than a measurement limit).

In the above, in Embodiments 1 to 4, the constitution in which the fixing belt 105 as an example of the rotatable member included in the fixing apparatus is rotationally driven by the pressing roller 102 is described, but for example, a constitution in which the fixing belt is supported by a plurality of supporting rollers and is rotationally driven by one of these supporting rollers may also be employed. Further, a constitution in which a fixing roller is used in place of the fixing belt may also be employed, Further, in Embodiments 1 to 4, the example in which the planar heater is used as the heating mechanism for heating the fixing belt is described, but for example, a constitution in which another heating mechanism, for heating the fixing belt by electromagnetic induction heating, such as an exciting coil, a halogen heater or an infrared lamp may also be employed. In this case, an urging pad for urging the fixing belt from an inside of the fixing belt toward the pressing roller is to be used. Further, a constitution in which the heating mechanism is disposed outside the fixing belt may also be employed.

Further, in Embodiments 1 to 4, the example in which the pressing roller 102 is used as the rotatable member included in the fixing apparatus is described, but for example, a constitution in which a pressing belt is used may also be employed.

While the invention has been described with reference to the structures disclosed herein, it is not confined to the details set forth and this application is intended to cover such modifications or changes as may come within the purpose of the improvements or the scope of the following claims.

This application claims priority from Japanese Patent Applications Nos. 209396/2012 and 162436/2013 filed Sep. 24, 2012 and Aug. 5, 2013, respectively, which are hereby incorporated by reference.

What is claimed is:

1. A fixing apparatus comprising:

first and second rotatable members configured to fix, at a nip therebetween, a toner image formed on a sheet by using a toner containing a parting agent;

a casing, configured to accommodate said first and second rotatable members, including a sheet introducing opening and a sheet discharging opening; and a suppressing portion configured to suppress diffusion, toward the sheet discharging opening, of particles having a predetermined diameter resulting from a parting agent, wherein said suppressing portion is provided in the neighborhood of a surface of said first rotatable member in a space in said casing from the sheet introducing opening to the sheet discharging opening, wherein when a gap between said suppressing portion and said first rotatable member is G (mm) and a peripheral speed of said first rotatable member is V (mm/s), the following relationship is satisfied:

$$0.5 \leq G \leq 0.0059 \times V + 0.72.$$

2. A fixing apparatus according to claim 1, wherein the following relationship is satisfied:

$$115 \leq V \leq 200.$$

3. A fixing apparatus according to claim 1, wherein said suppressing portion is provided in the neighborhood of the sheet introducing opening.

4. A fixing apparatus according to claim 1, wherein said suppressing portion is extended to each of outsides, with respect to a widthwise direction, of a region where an image formable region of a maximum width sheet usable in said fixing apparatus passes.

5. A fixing apparatus according to claim 1, wherein said parting agent is a wax and the predetermined particle size is 5.6 nm or more and 560 nm or less.

6. A fixing apparatus according to claim 1, wherein said first rotatable member is provided so as to be contactable to an unfixed toner image forming surface of the sheet.

7. A fixing apparatus according to claim 1, wherein said first rotatable member is provided so as to be contactable to an opposite surface, of the sheet, from an unfixed toner image forming surface of the sheet.

8. A fixing apparatus according to claim 1, wherein said first and second rotatable members are provided so that the sheet introducing opening is located below the sheet discharge opening with respect to a direction of gravitation.

9. A fixing apparatus comprising:

first and second rotatable members configured to fix, at a nip therebetween, a toner image formed on a sheet by using a toner containing a parting agent;

a casing, configured to accommodate said first and second rotatable members, including a sheet introducing opening and a sheet discharging opening;

a first suppressing portion configured to suppress diffusion, toward the sheet discharging opening, of particles having a predetermined diameter resulting from a parting agent, wherein said suppressing portion is provided in the neighborhood of a surface of said first rotatable member in a space in said casing from the sheet introducing opening to the sheet discharging opening; and a second suppressing portion configured to suppress diffusion, toward the sheet discharging opening, of particles having the predetermined diameter, wherein said suppressing portion is provided in the neighborhood of a surface of said second rotatable member in a space in said casing from the sheet introducing opening to the sheet discharging opening, wherein when a gap between said first suppressing portion and said first rotatable member is G1 (*mm*), a gap between said second suppressing portion and said second rotatable member is G2 (*mm*), and a peripheral speed of said first rotatable member is V (mm/s), the following relationships are satisfied:

$$0.5 \leq G1 \leq 0.0059 \times V + 0.72,$$

and $$0.5 \leq G2 \leq 0.0059 \times V + 0.72.$$

10. A fixing apparatus according to claim 9, wherein the following relationship is satisfied:

$$115 \leq V \leq 200.$$

11. A fixing apparatus according to claim 9, wherein each of said first and second suppressing portions is extended to each of outsides, with respect to a widthwise direction, of a region where an image formable region of a maximum width sheet usable in said fixing apparatus passes.

12. A fixing apparatus according to claim 9, wherein said parting agent is a wax and the predetermined particle size is 5.6 nm or more and 560 nm or less.

13. A fixing apparatus according to claim 9, wherein said first and second rotatable members are provided so that the sheet introducing opening is located below the sheet discharge opening with respect to a direction of gravitation.

* * * * *